US008635064B2

(12) United States Patent
Kuboyama

(10) Patent No.: US 8,635,064 B2
(45) Date of Patent: Jan. 21, 2014

(54) INFORMATION PROCESSING APPARATUS AND OPERATION METHOD THEREOF

(75) Inventor: Hideo Kuboyama, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 274 days.

(21) Appl. No.: 13/033,438

(22) Filed: Feb. 23, 2011

(65) Prior Publication Data

US 2011/0208516 A1 Aug. 25, 2011

(30) Foreign Application Priority Data

Feb. 25, 2010 (JP) ..... 2010-040598

(51) Int. Cl.
*G10L 21/02* (2013.01)

(52) U.S. Cl.
USPC ..... 704/226; 704/227; 704/228

(58) Field of Classification Search
USPC ..... 704/226–228
See application file for complete search history.

(56) References Cited

U.S. PATENT DOCUMENTS

| | | | | |
|---|---|---|---|---|
| 6,591,234 | B1 * | 7/2003 | Chandran et al. | 704/225 |
| 7,107,209 | B2 * | 9/2006 | Tabata et al. | 704/225 |
| 8,175,871 | B2 * | 5/2012 | Wang et al. | 704/227 |
| 8,194,880 | B2 * | 6/2012 | Avendano | 381/92 |
| 8,254,617 | B2 * | 8/2012 | Burnett | 381/355 |
| 8,311,817 | B2 * | 11/2012 | Murgia et al. | 704/227 |
| 2007/0021958 | A1 * | 1/2007 | Visser et al. | 704/226 |
| 2008/0201138 | A1 * | 8/2008 | Visser et al. | 704/227 |
| 2009/0164212 | A1 * | 6/2009 | Chan et al. | 704/226 |
| 2009/0240495 | A1 * | 9/2009 | Ramakrishnan et al. | 704/226 |
| 2010/0004927 | A1 * | 1/2010 | Endo et al. | 704/226 |
| 2010/0169082 | A1 * | 7/2010 | Konchitsky et al. | 704/203 |

FOREIGN PATENT DOCUMENTS

JP 2007-243856 A 9/2007

* cited by examiner

*Primary Examiner* — Douglas Godbold
(74) *Attorney, Agent, or Firm* — Canon USA Inc. IP Division

(57) ABSTRACT

An information processing apparatus includes an acquisition unit configured to acquire a first sound recorded from a first recording apparatus and a second sound recorded from a second recording apparatus that is different from the first recording apparatus, a determination unit configured to determine a frequency band representing a voice by analyzing a frequency of the first sound, and a change unit configured to, from among frequency components representing the second sound, change a frequency component in the frequency band.

8 Claims, 17 Drawing Sheets

INFORMATION PROCESSING APPARATUS AND OPERATION METHOD THEREOF

BACKGROUND OF THE INVENTION

1. Field of the Invention

The present invention relates to a technology for making it more difficult to listen to a portion of a sound output from a speaker.

2. Description of the Related Art

Recently, it is possible to use a display that is connected via a communication network to a monitoring camera installed at a remote location to view video captured by the monitoring camera. Further, if the monitoring camera has a microphone, it is also possible to use a speaker connected via the communication network to the microphone to listen to a sound recorded by the microphone.

Specifically, a viewer can realistically and richly see and hear what is happening at that remote location based on information acquired by the monitoring camera and the microphone installed at the remote location.

However, the sound recorded by the microphone may include a person's voice. Thus, if the viewer is allowed to listen to the recorded sound as is, the viewer may learn of personal information or confidential information regardless of the wishes of the person who is speaking.

Accordingly, a technology has been proposed which makes it more difficult to identify speech contents by attenuating the respective peaks (hereinafter, "formants") in a spectral envelope obtained when a spectrum constituting an audio signal, such as a person's voice, is plotted along the frequency axis (for example, see Japanese Patent Application Laid-Open No. 2007-243856).

Although the technology discussed in Japanese Patent Application Laid-Open No. 2007-243856 enables most of the sounds from the remote location to be perceived, this technology makes it more difficult to identify the speech contents represented by the person's voice included in the sound recorded by the microphone that can be clearly identified.

However, for example, if the viewer adjusts the speaker volume and listens carefully, among the people's voices included in the sound recorded by the microphone, the speech contents of voices that, although not clearly, can be barely identified might be identifiable.

SUMMARY OF THE INVENTION

The present invention is directed to an information processing apparatus capable of making it more difficult to listen to a voice whose speech contents can be identified if the voice included in a sound recorded by a predetermined microphone is listened to carefully.

According to an aspect of the present invention, an information processing apparatus includes an acquisition unit configured to acquire a first sound recorded from a first recording apparatus and a second sound recorded from a second recording apparatus that is different from the first recording apparatus, a determination unit configured to determine a frequency band representing a voice by analyzing a frequency of the first sound, and a change unit configured to, from among frequency components representing the second sound, change a frequency component in the frequency band.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1A:
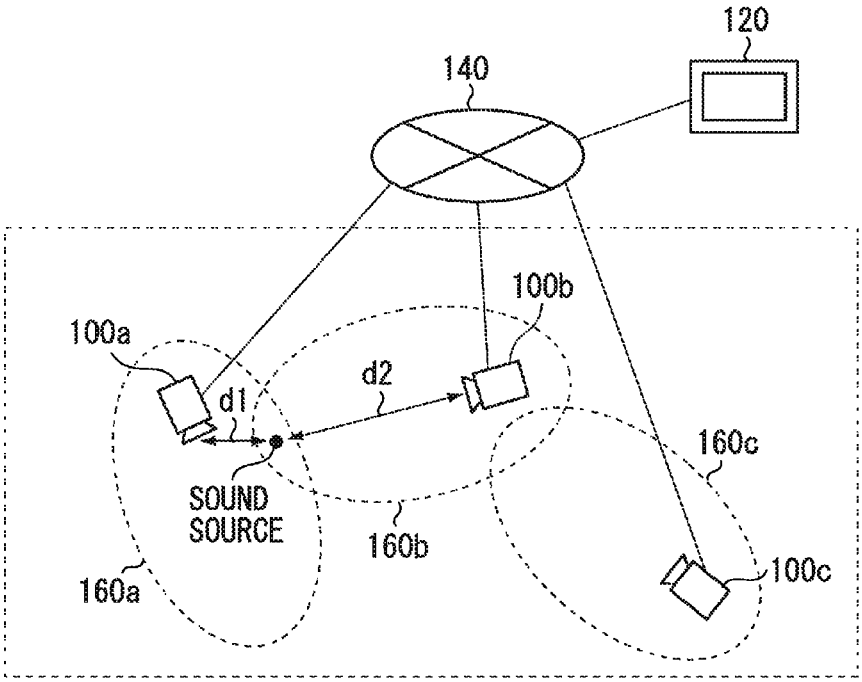
FIGS. 1A and 1B schematically illustrate an example of an information processing system according to a first exemplary embodiment of the present invention.

FIG. 1A schematically illustrates an example of an information processing system according to a first exemplary embodiment of the present invention.

In FIG. 1A, an information processing system has recording apparatuses 100*a*, 100*b*, and 100*c*, an output apparatus 120, and a network 140. The respective units of the information processing system will now be described.

The recording apparatuses 100*a*, 100*b*, and 100*c* are configured from, for example, a monitoring camera for capturing video and a microphone for recording a sound for acquiring videos and sounds. The output apparatus 120 is configured from, for example, a display for displaying videos, and a speaker for outputting sounds. The videos and sounds captured/recorded by the recording apparatuses are provided to a viewer. The network 140 connects the recording apparatuses

100*a*, 100*b*, and 100*c* with the output apparatus 120, and enables communication among the recording apparatuses 100*a*, 100*b*, and 100*c*, or alternatively, between the recording apparatuses 100*a*, 100*b*, and 100*c* and the output apparatus 120.

In the present exemplary embodiment, although the information processing system has three recording apparatuses, the number of recording apparatuses is not limited to three. Further, if the number of recording apparatuses is increased, the communication among recording apparatuses is not limited to recording apparatuses whose sound recording ranges overlap. More specifically, if the recording range of the recording apparatuses 100*a*, 100*b*, and 100*c* is respectively a recording range 160*a*, 160*b*, and 160*c*, the recording apparatuses 100*a* and 100*c* do not necessarily have to be able to communicate with each other. The "recording range" of the respective recording apparatuses is a space that is determined based on the installation position and orientation of each of the recording apparatuses, and the volume of the sound recorded by each of the recording apparatuses.

Figure 1B:
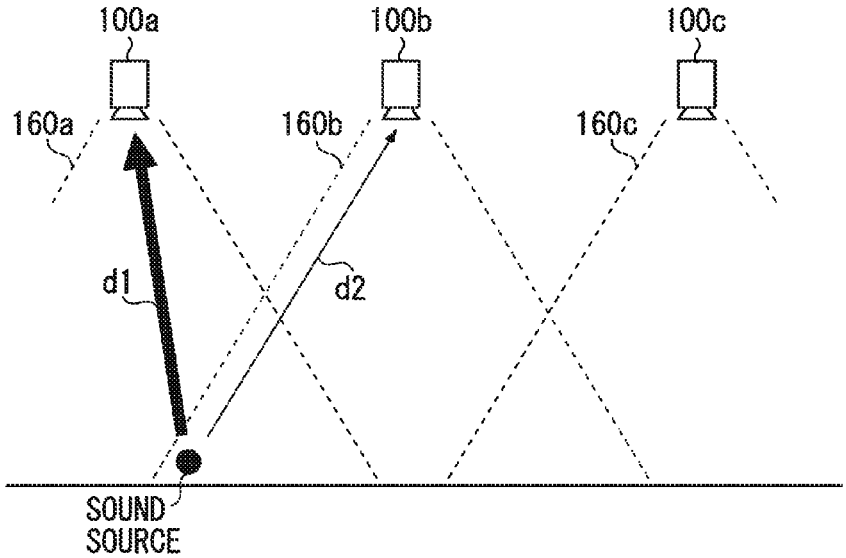

FIG. 1B is a diagram of a space in which the information processing system according to the present exemplary embodiment is installed as viewed from a lateral direction. The respective units illustrated in FIG. 1B are denoted with the same reference numerals as the units illustrated in FIG. 1A, and thus a description thereof will be omitted here.

Figure 2A:
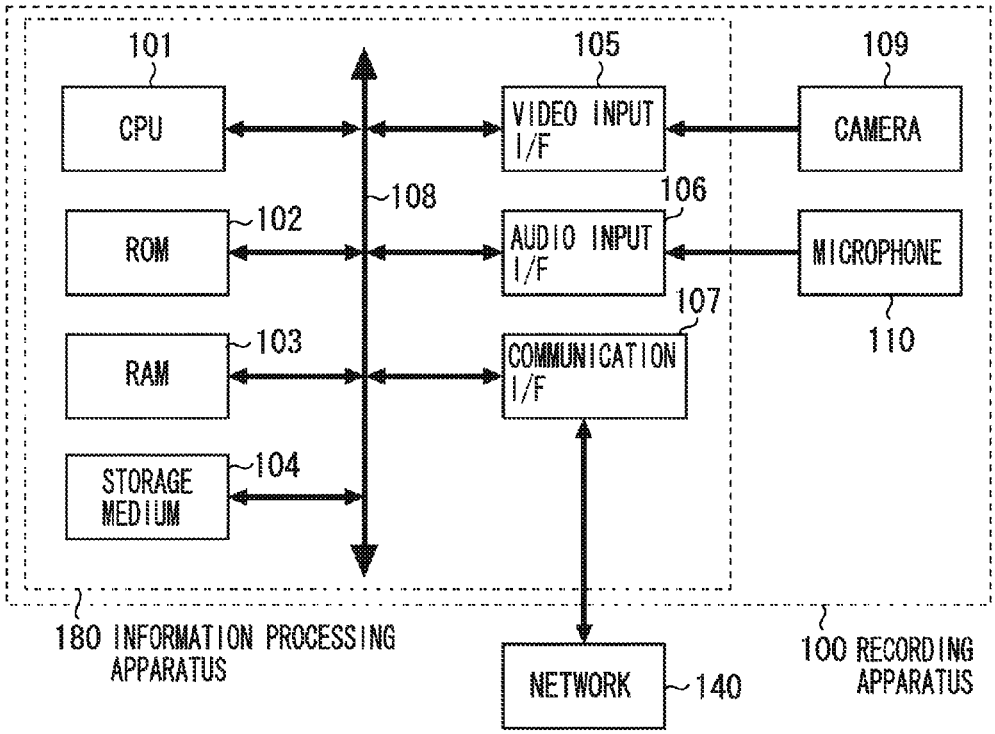
FIGS. 2A and 2B illustrate an example of a configuration of a recording apparatus and an information processing apparatus according to the first exemplary embodiment.

FIG. 2A illustrates an example of a hardware configuration of a recording apparatus 100, which corresponds to the respective recording apparatuses 100*a*, 100*b*, and 100*c*. The recording apparatus 100 is configured from a camera 109, a microphone 110, and an information processing apparatus 180.

The information processing apparatus 180 has a central processing unit (CPU) 101, a read-only memory (ROM) 102, a random access memory (RAM) 103, a storage medium 104, a video input interface (I/F) 105, an audio input I/F 106, and a communication I/F 107. The respective parts are connected via a system bus 108. These units will now be described below.

The CPU 101 realizes each of the below-described functional blocks by opening and executing on the RAM 103 a program stored in the ROM 102. The ROM 102 stores the programs that are executed by the CPU 101. The RAM 103 provides a work area for opening the programs stored in the ROM 102. The storage medium 104 stores data output as a result of execution of the various processes described below.

The video output I/F 105 acquires video captured by the camera 109. The audio output I/F 106 acquires a sound recorded by the microphone 110. The communication I/F 107 transmits and receives various data via the network 140.

Figure 2B:
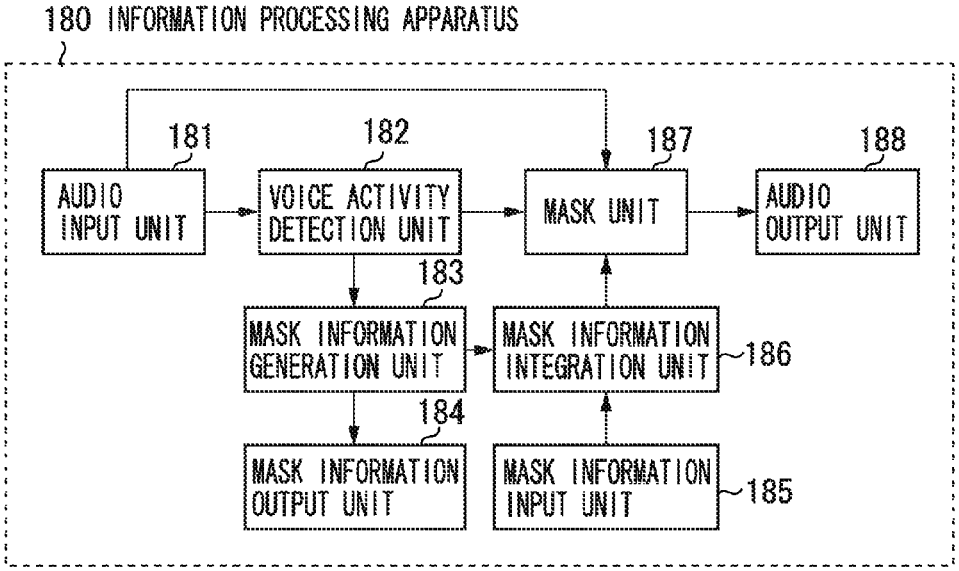

FIG. 2B is a function block diagram illustrating an example of a functional configuration of the information processing apparatus 180. The information processing apparatus 180 has an audio input unit 181, a voice activity detection unit 182, a mask information generation unit 183, a mask information output unit 184, a mask information input unit 185, a mask information integration unit 186, a mask unit 187, and an audio output unit 188. The functions of these units are realized by the CPU 101 opening and executing on the RAM 103 a program stored in the ROM 102. These units will now be described below.

The audio input unit 181 inputs a sound acquired by the audio input I/F 106. The voice activity detection unit 182 detects a speech segment including a person's voice from among the sounds input into the audio input unit 181. The mask information generation unit 183 generates mask information for making it more difficult to listen to a person's voice included in the segment detected by the voice activity detection unit 182. This mask information will be described below. The mask information output unit 184 outputs to the communication I/F 107 a predetermined signal representing the mask information generated by the mask information generation unit 183 in order to transmit the mask information to another recording apparatus.

The mask information input unit 185 inputs this mask information when a signal representing the mask information sent from another recording apparatus is received by the communication I/F 107. When the mask information generated by the mask information generation unit 183 and separate mask information input from the mask information input unit 185 have been input, the mask information integration unit 186 executes processing for integrating such mask information. This processing for integrating the mask information will be described below.

The mask unit 187 executes processing for making it more difficult to listen to a portion of the sound input by the audio input unit 181, based on the mask information generated by the mask information generation unit 183, the mask information input from the mask information input unit 185, or the mask information integrated by the mask information integration unit 186. The processing for making it more difficult to listen to a portion of the input sound will be described below.

The audio output unit 188 outputs the predetermined signal representing the sound to the communication I/F 107 in order to output to the output apparatus 120 the sound changed by the mask unit 187 to make it more difficult to listen to a portion of the sound. If there is no mask information corresponding to the sound input by the audio input unit 181, and it is not necessary to make it more difficult to listen to a portion of the sound, the audio output unit 188 outputs a predetermined signal representing the sound input by the audio input unit 181 as is.

Next, the processing for making it more difficult to listen to a voice that can, although not clearly, barely be identified from among the people's voices included in a sound will be described.

FIGS. 3A to 3I and FIGS. 4A to 4I illustrate a sound including a person's voice output from a sound source that was recorded by the recording apparatuses 100*a* and 100*b*, respectively, illustrated in FIGS. 1A and 1B. Here, a distance d1 between the sound source and the recording apparatus 100*a* illustrated in FIGS. 1A and 1B is less than a distance d2 between the sound source and the recording apparatus 100*b* (i.e., d1<d2).

Figure 3A:
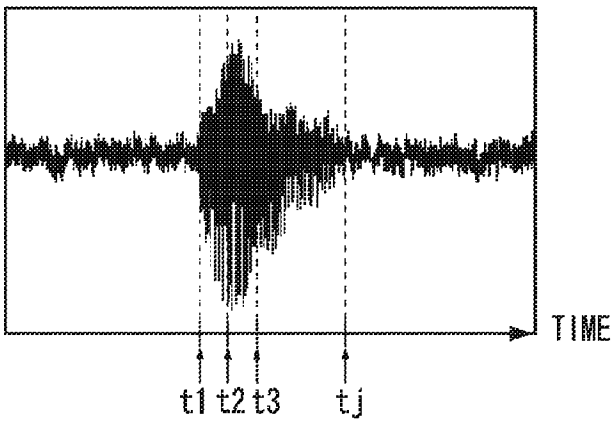
FIGS. 3A to 3I illustrate a sound recorded by each of the two recording apparatuses illustrated in FIGS. 1A and 1B.
Figure 3B:
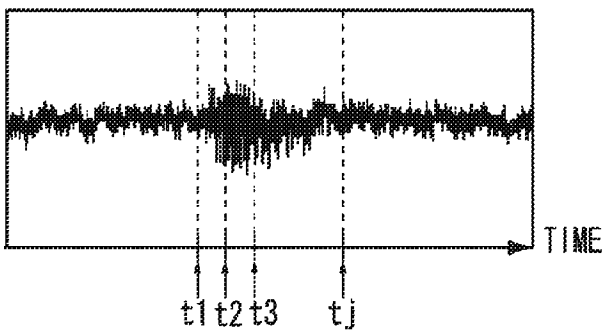
Figure 4C:
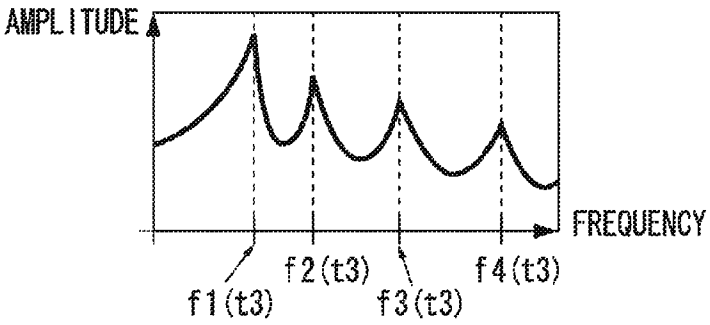
FIGS. 4A to 4I illustrate a sound recorded by each of the two recording apparatuses illustrated in FIGS. 1A and 1B.
Figure 4D:
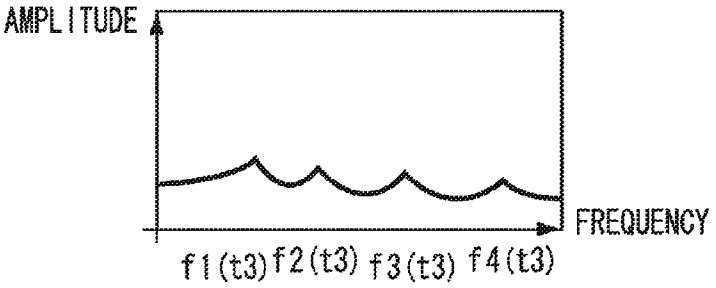
Figure 4E:
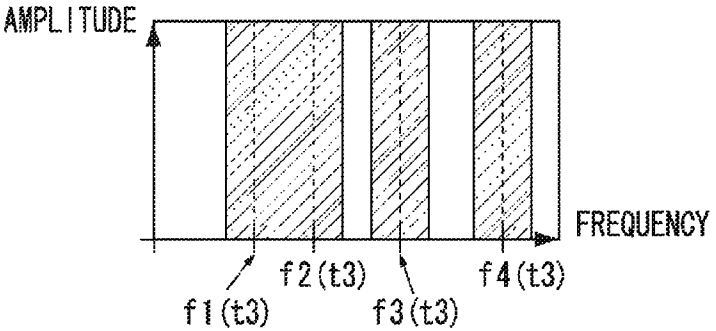
Figure 4A:
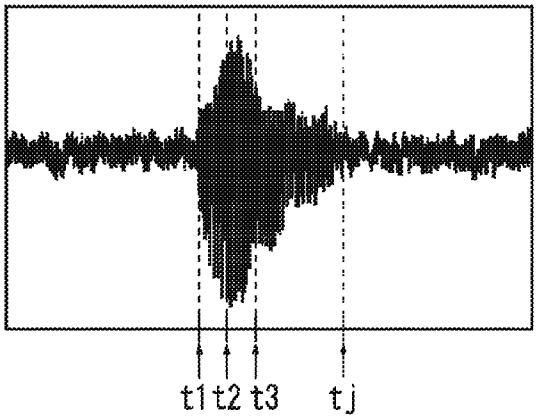
Figure 4B:
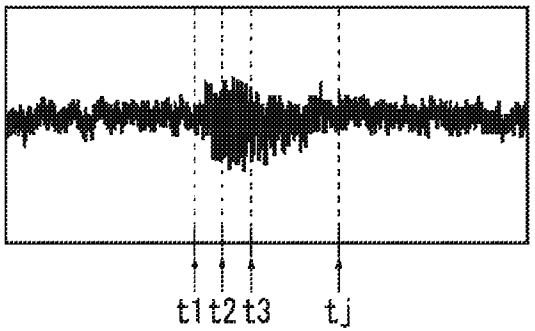

FIGS. 3A and 4A illustrate a waveform of the sound recorded by the recording apparatus 100*a*. FIGS. 3B and 4B illustrate a waveform of the sound recorded by the recording apparatus 100*b*. A segment from time t1 to time tj in this plurality of figures is a speech segment representing a person's voice.

Further, a segment of a sound representing a person's voice, specifically, a speech segment, is determined using a known method, such as a method for determining based on the acoustic power, a method for determining based on the number of zero-crossings, and a method for determining based on likelihood with respect to both voice and non-voice models.

Figure 3C:
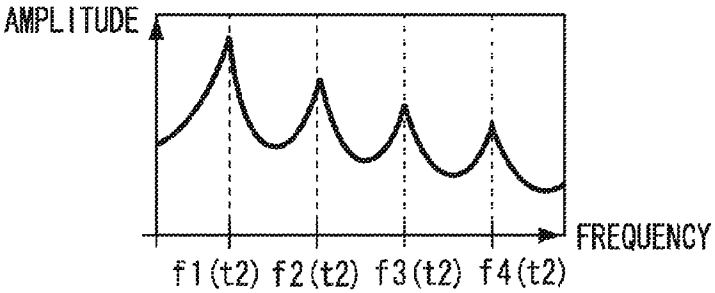
Figure 3D:
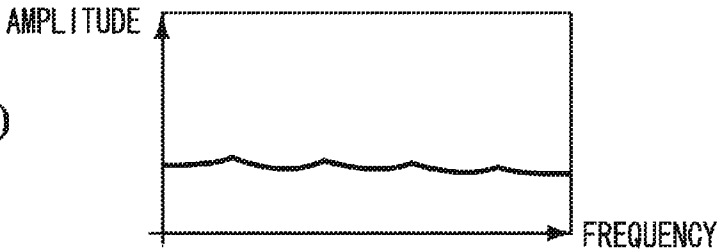

FIG. 3C illustrates a spectral envelope (envelope curve) obtained by analyzing the frequency of the sound recorded by the recording apparatus 100*a* at time t2. FIG. 3D illustrates a spectral envelope obtained by analyzing the frequency of the sound recorded by the recording apparatus 100*b* at the same time. The frequency analysis may be, for example, a known linear prediction analysis (LPC analysis).

In FIG. 3C, the frequencies corresponding to the respective formant peaks are, in order of smaller frequency, f1 (t2), f2 (t2), f3 (t2), and f4 (t2). On the other hand, in FIG. 3D, formants are not determined.

Generally, a voice spectrum can be represented as a spectral envelope representing the overall shape, and as a detailed spectrum structure representing fine variations. Spectral envelopes are known to represent phonemes (vowels etc.), and detailed spectrum structures are known to represent the characteristics of the voice of the person who is speaking.

Specifically, by making peaks disappear by causing each of the formants to attenuate, a voice constituted from a plurality of phonemes can be made more difficult to listen to.

Figure 3E:
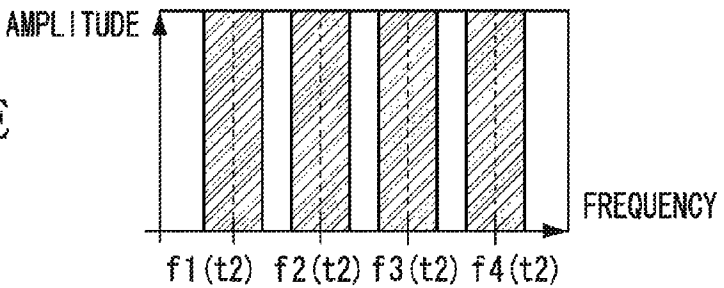

FIG. 3E schematically illustrates the above-described mask information. This "mask information" is information representing a frequency band (the hatched portion) near f1 (t2), f2 (t2), f3 (t2), and f4 (t2).

Figure 3F:
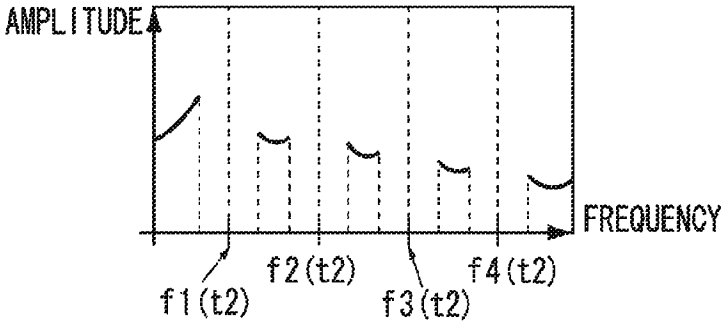

FIG. 3F schematically illustrates changes made to the spectral envelope illustrated in FIG. 3C using the mask information illustrated in FIG. 3E. In FIG. 3F, each component of the frequency bands near f1 (t2), f2 (t2), f3 (t2), and f4 (t2) is removed. The method for changing the spectral envelope is not limited to a method for removing a predetermined frequency band component. Other methods may include attenuating a predetermined frequency band component.

Figure 3G:
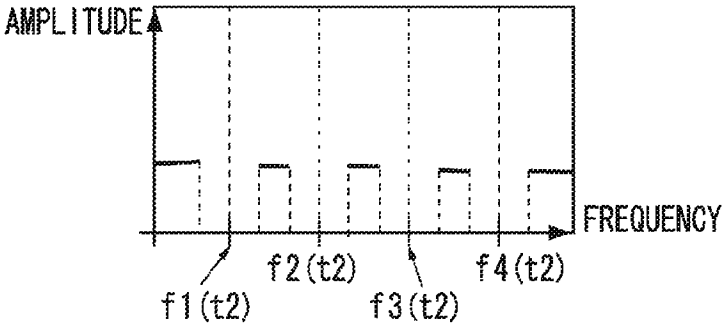
Figure 3H:
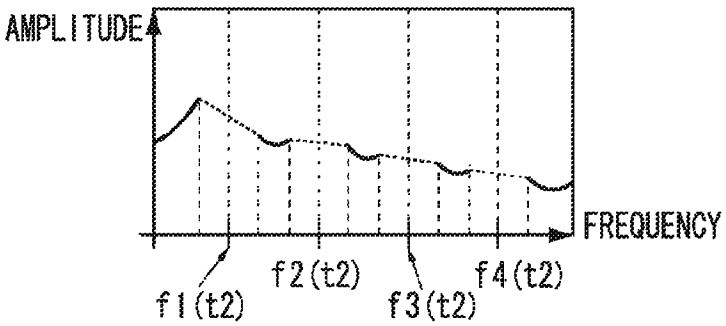

FIG. 3H schematically illustrates interpolation processing performed when each component of the frequency bands near f1 (t2), f2 (t2), f3 (t2), and f4 (t2) is removed or substantially attenuated. In FIG. 3H, this frequency band component (bold broken line) is determined based on the frequency component adjacent to the frequency bands near f1 (t2), f2 (t2), f3 (t2), and f4 (t2).

Thus, a voice that can be clearly identified from among the people's voices included in a sound can be made more difficult to listen to by attenuating the formants illustrated in FIG. 3C in the manner illustrated in FIG. 3H.

FIG. 3G schematically illustrates changes made to the spectral envelope illustrated in FIG. 3D using the mask information illustrated in FIG. 3E. In FIG. 3G, each component of the frequency bands near f1 (t2), f2 (t2), f3 (t2), and f4 (t2) is removed. The method for changing the spectral envelope is not limited to a method for removing a predetermined frequency band component. Other methods may include attenuating a predetermined frequency band component, and moving the formant frequency positions.

Figure 3I:
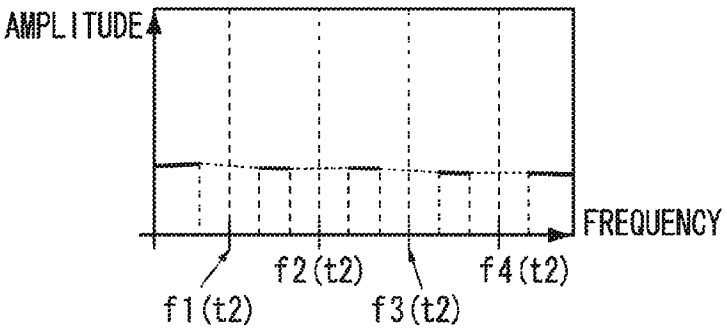

FIG. 3I schematically illustrates interpolation processing performed when each component of the frequency bands near f1 (t2), f2 (t2), f3 (t2), and f4 (t2) is removed or substantially attenuated. In FIG. 3I, this frequency band component (bold broken line) is determined based on the frequency component adjacent to the frequency bands near f1 (t2), f2 (t2), f3 (t2), and f4 (t2).

Thus, although not clearly identifiable, a voice that can barely be identified from among the people's voices included in a sound can be made more difficult to listen to by attenuating the formants, whose peaks illustrated in FIG. 3D are not clear, in the manner illustrated in FIG. 3I.

FIG. 4C illustrates a spectral envelope obtained by analyzing the frequency of the sound recorded by the recording apparatus 100*a* at time t3. FIG. 4D illustrates a spectral envelope obtained by analyzing the frequency of the sound recorded by the recording apparatus 100*b* at the same time.

In FIG. 4C, the frequencies corresponding to the respective formant peaks are, in order of smaller frequency, f1 (t3), f2 (t3), f3 (t3), and f4 (t3). On the other hand, in FIG. 4D, formants are not determined.

As illustrated in FIGS. 3C, 3D, 4C, and 4D, since the spectral envelope is sequentially changed, the frequency corresponding to each formant peak is determined for each predetermined period of time.

FIG. 4E schematically illustrates the above-described mask information. This "mask information" is information representing a frequency band (the hatched portion) near f1 (t3), f2 (t3), f3 (t3), and f4 (t3).

Figure 4F:
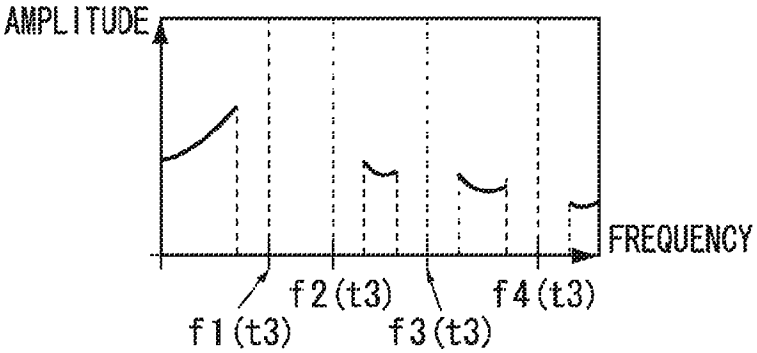

FIG. 4F schematically illustrates changes made to the spectral envelope illustrated in FIG. 4C using the mask information illustrated in FIG. 4E. In FIG. 4F, each component of the frequency bands near f1 (t3), f2 (t3), f3 (t3), and f4 (t3) is removed.

Figure 4G:
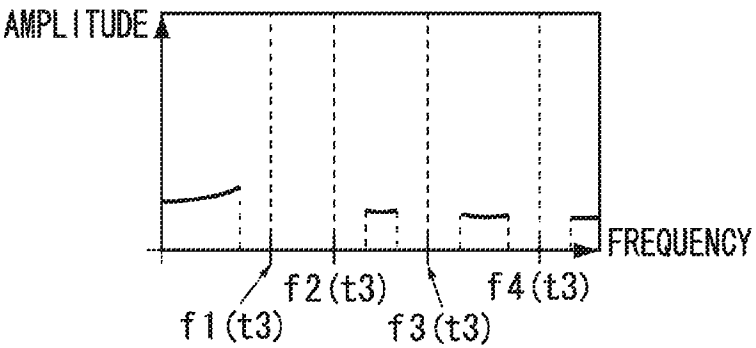
Figure 4H:
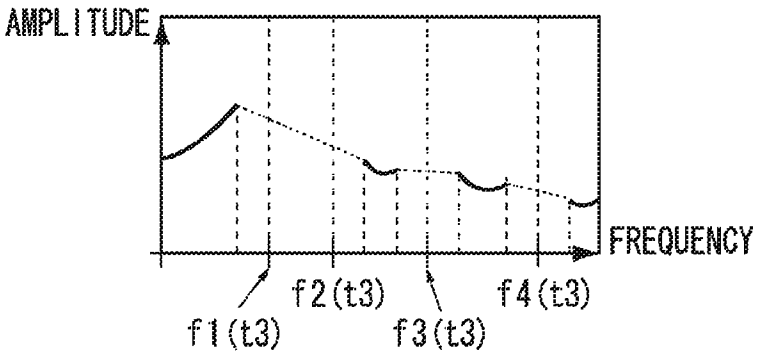

FIG. 4H schematically illustrates interpolation processing performed when each component of the frequency bands near f1 (t3), f2 (t3), f3 (t3), and f4 (t3) is removed or substantially attenuated. In FIG. 4H, this frequency band component (bold broken line) is determined based on the frequency component adjacent to the frequency bands near f1 (t3), f2 (t3), f3 (t3), and f4 (t3).

Thus, a voice that can be clearly identified from among people's voices included in a sound can be made more difficult to listen to by attenuating the formants illustrated in FIG. 4C in the manner illustrated in FIG. 4H.

FIG. 4G schematically illustrates changes made to the spectral envelope illustrated in FIG. 4D using the mask information illustrated in FIG. 4E. In FIG. 4G, each component of the frequency bands near f1 (t3), f2 (t3), f3 (t3), and f4 (t3) is removed.

Figure 4I:
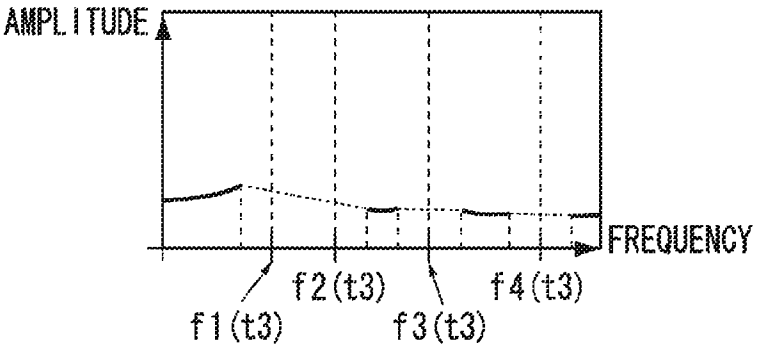

FIG. 4I schematically illustrates the interpolation processing performed when each component of the frequency bands near f1 (t3), f2 (t3), f3 (t3), and f4 (t3) is removed or substantially attenuated. In FIG. 4I, this frequency band component (bold broken line) is determined based on the frequency component adjacent to the frequency bands near f1 (t3), f2 (t3), f3 (t3), and f4 (t3).

Thus, although not clearly identifiable, a voice that can barely be identified from among people's voices included in a sound can be made more difficult to listen to by attenuating the formants, whose peaks illustrated in FIG. 4D are not clear, in the manner illustrated in FIG. 4I.

In the present exemplary embodiment, at each time point, although the frequency components of the frequency bands corresponding to the peaks of four formants were changed in order of smaller frequency, the number of frequency bands is not limited to four.

Figure 5:
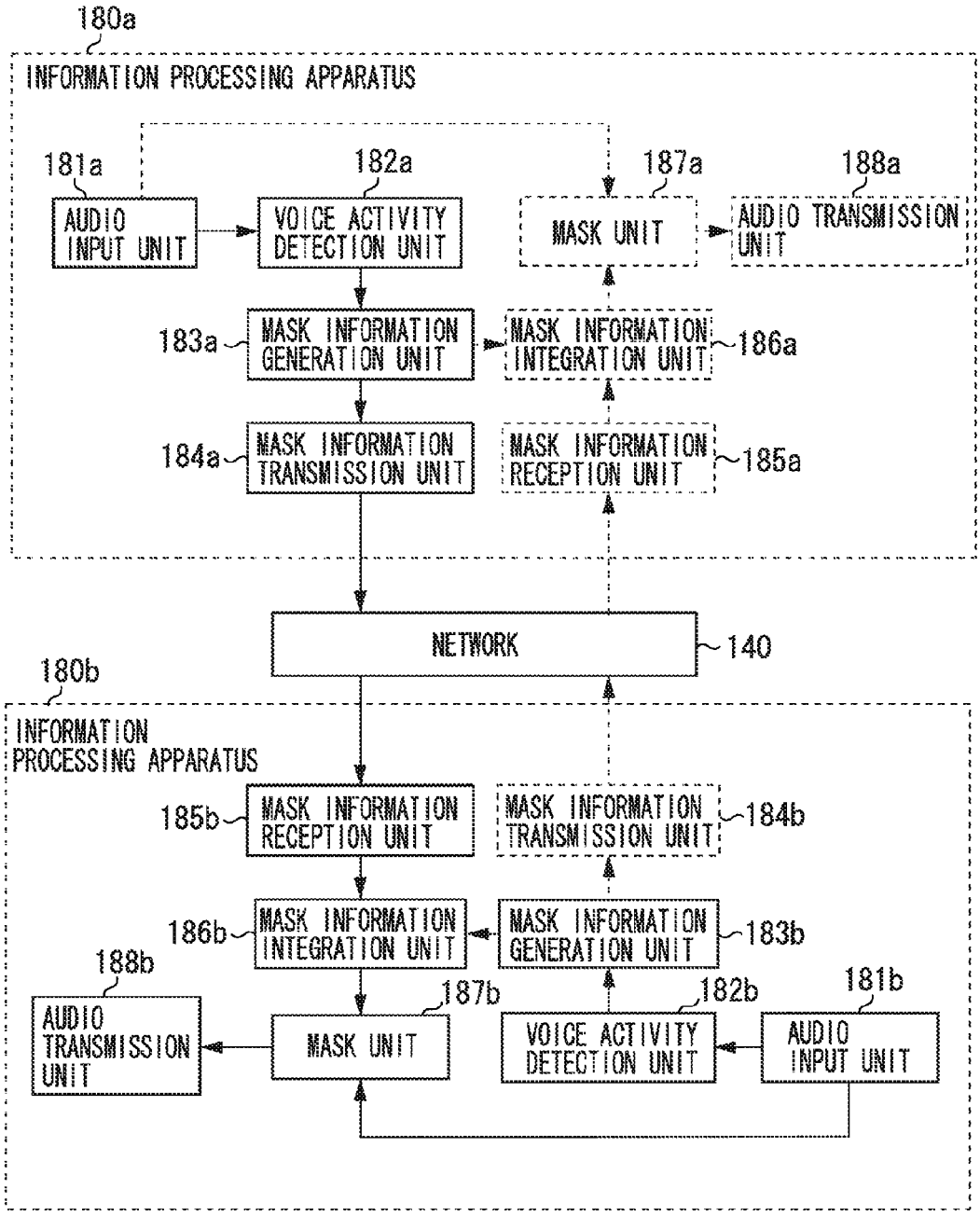
FIG. 5 illustrates an example of a configuration of each of two information processing apparatuses according to the first exemplary embodiment.

FIG. 5 illustrates a configuration of the information processing apparatus of the recording apparatuses 100*a* and 100*b*. In FIG. 5, the information processing apparatus corresponding to the recording apparatus 100*a* is an information processing apparatus 180*a*, and the information processing apparatus corresponding to the recording apparatus 100*b* is an information processing apparatus 180*b*. Further, the units in the information processing apparatus 180*a* are respectively denoted with reference numerals 181*a* to 188*a*, and the units in the information processing apparatus 180*b* are respectively denoted with reference numerals 181*b* to 188*b*. These units 181*a* to 188*a* and 181*b* to 188*b* respectively have the same function as the units 181 to 188 illustrated in FIG. 2B.

Figure 6:
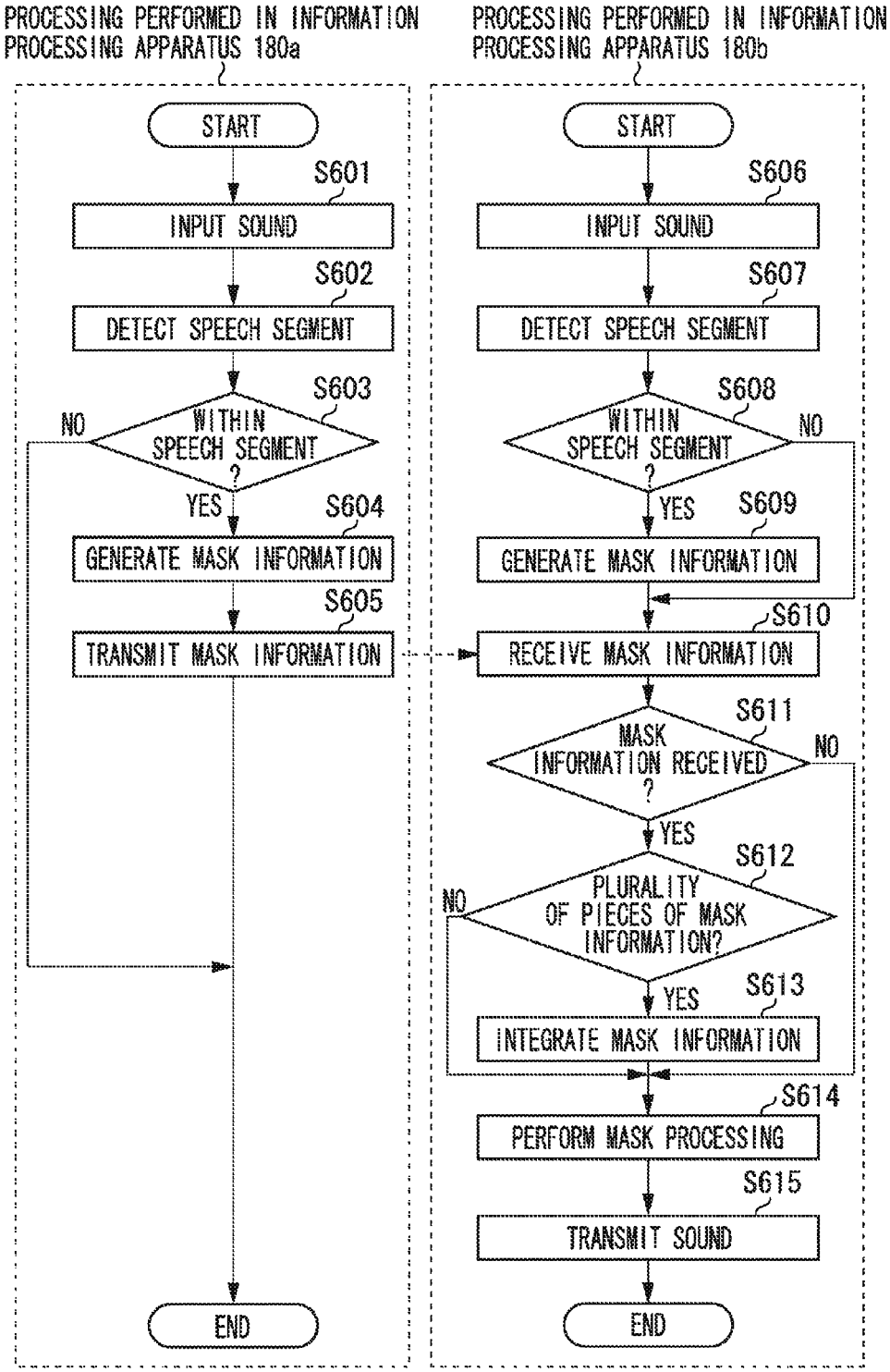
FIG. 6 is a flowchart illustrating processing for making it more difficult to listen to a person's voice included in a recorded sound according to the first exemplary embodiment.

FIG. 6 is a flowchart illustrating a processing operation in which the information processing apparatus 180*a* and the information processing apparatus 180*b* cooperate to make it more difficult to listen to a person's voice included in a sound recorded by the recording apparatus 100*b*.

The processing performed in steps S601 to S605 is executed by the information processing apparatus 180*a*, and the processing performed in steps S606 to S615 is executed by the information processing apparatus 180*b*.

First, in step S601, the audio input unit 181*a* inputs the sound recorded via the microphone of the recording apparatus 100*a* into the voice activity detection unit 182*a* and the mask unit 187*a*.

Next, in step S602, the voice activity detection unit 182*a* executes processing for detecting speech segments in the input sound.

Next, in step S603, the voice activity detection unit 182*a* determines whether each time point serving as a boundary when the input sound is divided into predetermined smaller periods lies within a speech segment. If it is determined that a time point does lie within a speech segment (YES in step S603), the processing of step S604 is then executed.

On the other hand, in step S603, if the voice activity detection unit 182*a* determines that the time point serving as the processing target does not lie within a speech segment (NO in step S603), the series of processes performed by the information processing apparatus 180*a* is finished.

In step S604, the mask information generation unit 183*a* generates mask information for each time point determined by the voice activity detection unit 182*a* as lying within a speech segment.

Next, in step S605, the mask information output unit 184*a* converts the mask information generated by the mask information generation unit 183*a* into a predetermined signal, and transmits the signal to another information processing apparatus (in the present exemplary embodiment, the information processing apparatus 180*b*).

In step S606, the audio input unit 181*b* inputs the sound recorded via the microphone of the recording apparatus 100*b* into the voice activity detection unit 182*b* and the mask unit 187*b*.

Next, in step S607, the voice activity detection unit 182*b* executes processing for detecting speech segments in the input sound.

Next, in step S608, the voice activity detection unit 182*b* determines whether each time point serving as a boundary when the input sound is divided into predetermined smaller periods lies within a speech segment. If it is determined that a time point does lie within a speech segment (YES in step S608), the processing of step S609 is then executed.

On the other hand, in step S608, if the voice activity detection unit 182*b* determines that the time point serving as the processing target does not lie within a speech segment (NO in step S608), the processing of step S610 is then executed.

In step S609, the mask information generation unit 183*b* generates mask information for each time point determined by the voice activity detection unit 182*b* as lying within a speech segment.

Next, in step S610, the mask information reception unit 185*b* executes processing for receiving a signal that represents the mask information transmitted by the mask information output unit 184*a*.

Next, in step S611, the mask information reception unit 185*b* determines whether a signal representing the mask information has been received. If it is determined that such a signal has been received (YES in step S611), the processing of step S612 is then executed.

On the other hand, in step S611, if the mask information reception unit 185*b* determines that a signal representing the mask information has not been received (NO in step S611), the processing of step S614 is then executed.

In step S612, the mask information integration unit 186*b* determines whether there is a plurality of pieces of mask information. If it is determined that there is a plurality of pieces of mask information (YES in step S612), the processing of step S613 is then executed.

On the other hand, in step S612, if it is determined that there is only one piece of mask information (NO in step S612), the processing of step S614 is then executed.

The expression "there is a plurality of pieces of mask information" refers to a state in which the mask information reception unit 185*b* received a signal representing mask information for a predetermined time t, and the mask information generation unit 183*b* generated mask information for the same time t.

In step S613, the mask information integration unit 186*b* executes processing for integrating the mask information. The processing for integrating the mask information will be described below.

Next, in step S614, the mask unit 187*b* executes processing for masking the sound input by the audio input unit 181*b* based on one piece of mask information or the mask information integrated by the mask information integration unit 186*b*.

This "mask processing" is the processing illustrated in FIGS. 3A to 3I and FIGS. 4A to 4I, and refers to processing for making it more difficult to listen to a person's voice included in a sound. If there is no mask information, the mask processing illustrated in step S614 is not executed.

Next, in step S615, the audio transmission unit 188*b* transmits a signal representing a sound which has undergone appropriate mask processing to the output apparatus 120.

The above is the processing for making it more difficult to listen to a person's voice included in a sound recorded by the recording apparatus 100*b*.

FIGS. 7A to 7E schematically illustrate processing for integrating mask information.

Figure 7B:
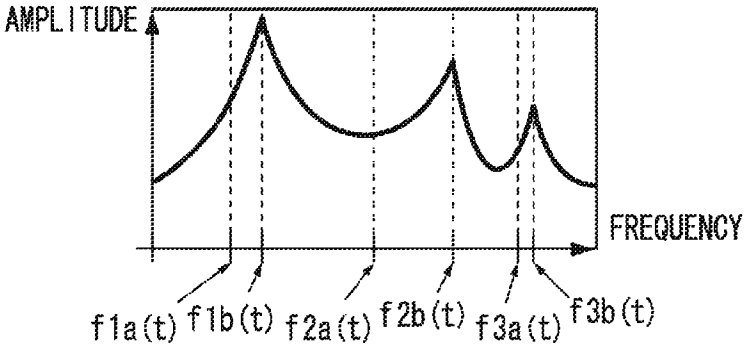
FIGS. 7A to 7E schematically illustrate processing for integrating mask information.
Figure 7A:
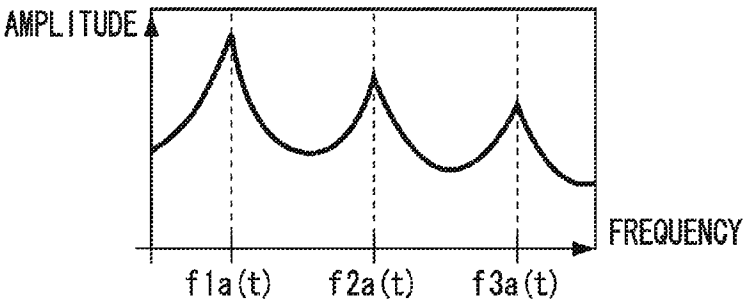

FIG. 7A illustrates a spectral envelope of a sound recorded by the recording apparatus 100*a* at time t. FIG. 7B illustrates a spectral envelope of a sound recorded by the recording apparatus 100*b* at time t.

Figure 7D:
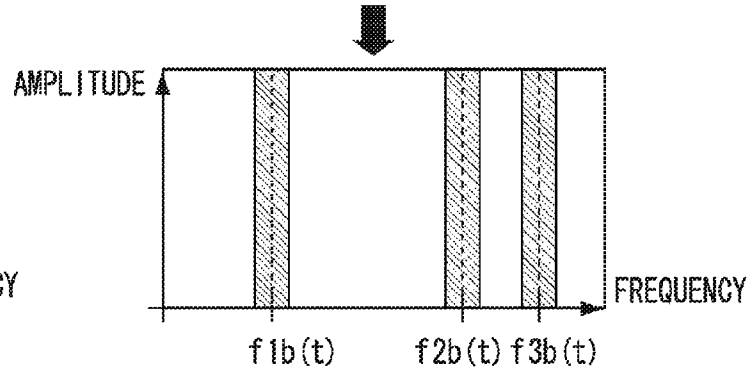
Figure 7C:
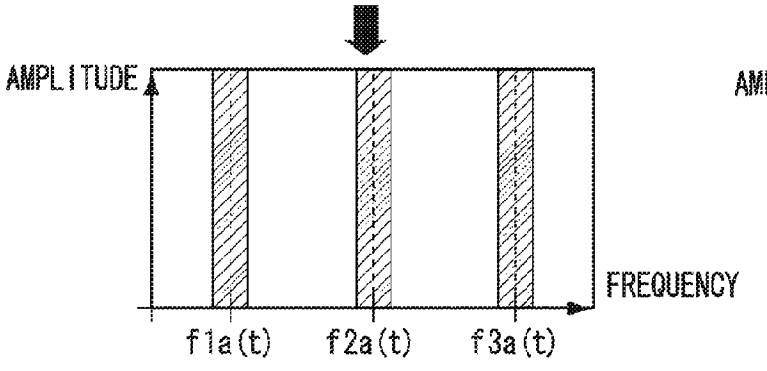

Further, FIG. 7C schematically illustrates mask information corresponding to a sound recorded by the recording apparatus 100*a* at time t. FIG. 7D schematically illustrates mask information corresponding to a sound recorded by the recording apparatus 100*b* at time t. The hatched portions in FIGS. 7C and 7D represent the frequency bands that serve as a target for the above-described mask processing.

Figure 7E:
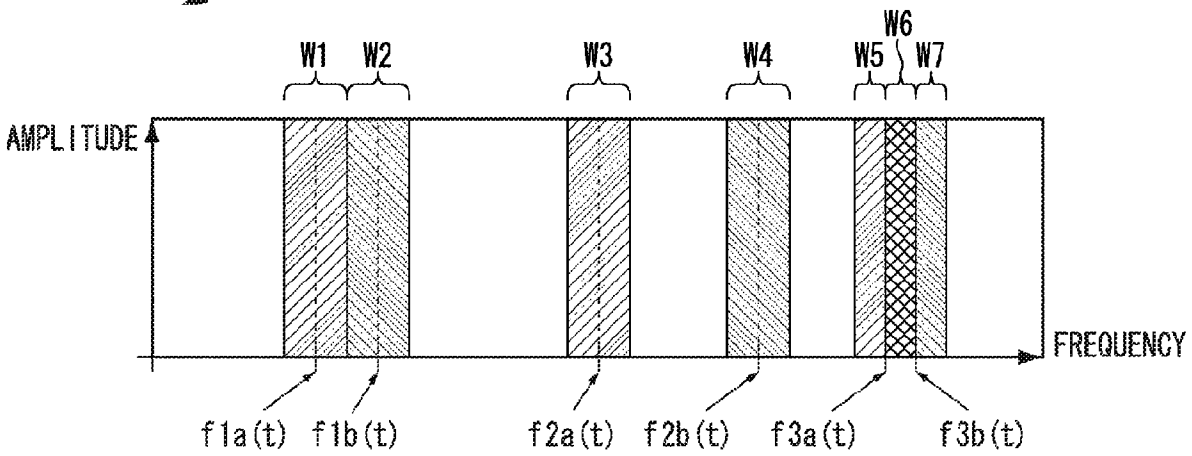

FIG. 7E schematically illustrates the mask information illustrated in FIGS. 7C and 7D as it looks after being integrated.

The respective frequency bands (W1 to W7) serving as the targets for mask processing may also be set as identifiable information so that the level of mask processing performed on a W1, W3, and W5 group, a W2, W3, and W7 group, and W6, respectively, can be changed. The "level of mask processing" refers to the width, proportion etc., where the respective formants are attenuated by when the mask processing is processing in which each formant is attenuated, for example. Specifically, the mask information integration unit can set the width, proportion etc. for attenuating a formant based on the mask information received from another information processing apparatus to be smaller than the width, proportion etc. for attenuating a formant based on the mask information generated by its own information processing apparatus.

Further, when the frequency band represented by the mask information received from another information processing apparatus and the frequency band representing the mask information generated by its own information processing apparatus overlap, the mask information integration unit may adjust the width, proportion etc. for attenuating a formant to the larger frequency band.

In addition, the mask information integration unit may determine the width, proportion etc. for attenuating a formant based on relationship among the installation position of its own recording apparatus, the installation position of the recording apparatus corresponding to the information processing apparatus that transmitted the mask information, the sound source position and the like.

Figure 8:
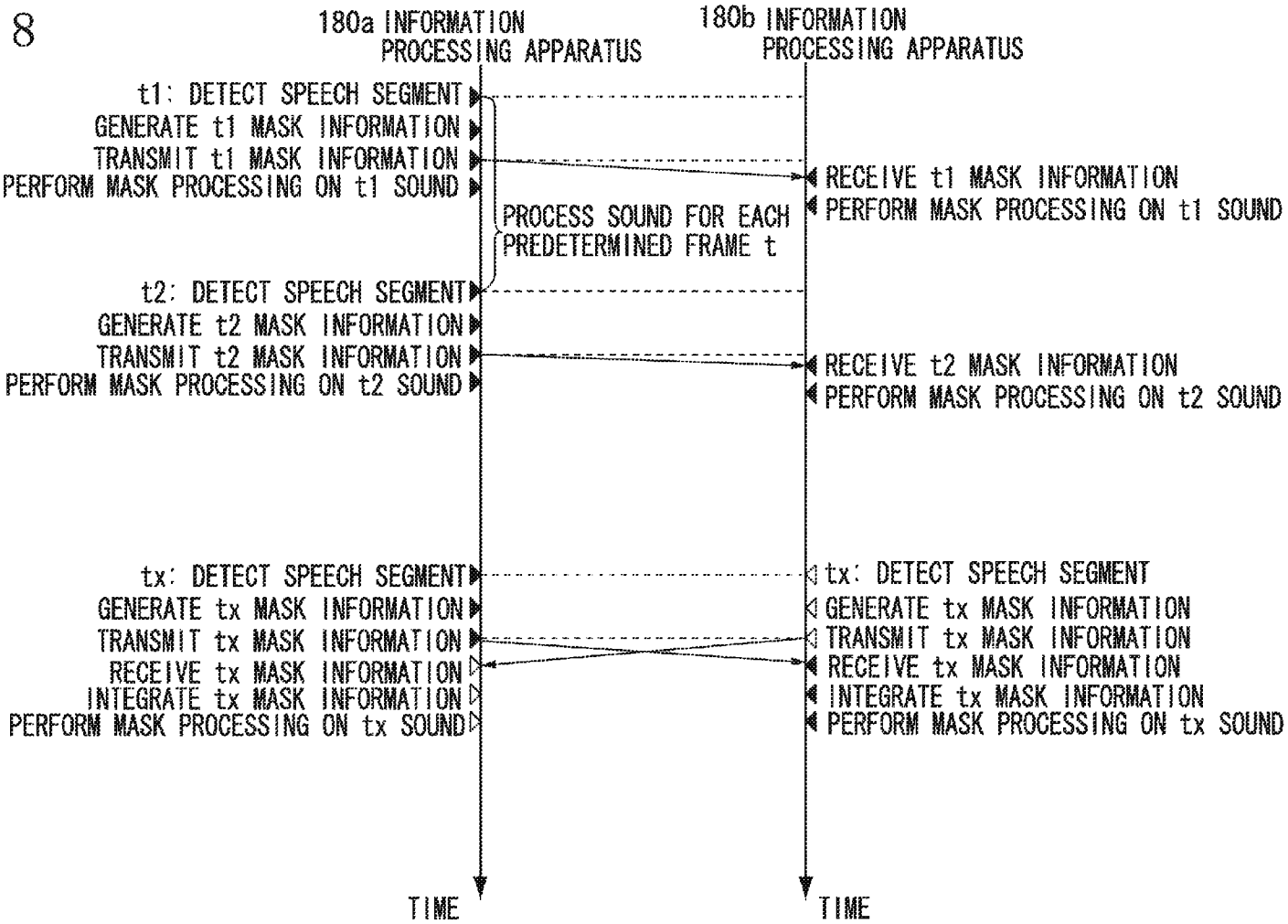
FIG. 8 illustrates a temporal flow of mask processing.

FIG. 8 illustrates a temporal flow of the mask processing executed by the information processing apparatuses corresponding to the recording apparatuses, respectively. The respective information processing apparatuses process the sound for each predetermined time (frame), detect speech segments, generate mask information, and execute mask processing.

First, at time t1, when the information processing apparatus 180*a* detects a speech segment, the information processing apparatus 180*a* generates mask information for the time t1, transmits this mask information to the information processing apparatus 180*b*, and then executes mask processing on the time t1 sound.

After the information processing apparatus 180*b* has received the mask information for time t1 from the information processing apparatus 180*a*, the information processing apparatus 180*b* executes mask processing on the sound at time t1 received by the recording apparatus 100*b*. In this example, the information processing apparatus 180*b* does not detect a speech segment at time t1. Further, in FIG. 8, the same processing is performed at time t2 as was performed at time t1.

On the other hand, at time tx, speech segment detection processing is performed by both the information processing apparatus 180*a* and the information processing apparatus 180*b*. In this case, the information processing apparatus 180*a* transmits mask information to the information processing apparatus 180*b*, and the information processing apparatus 180*b* transmits mask information to information processing apparatus 180*a*, respectively.

Next, when the respective mask information is received, the information processing apparatuses 180*a* and 180*b* integrate the mask information generated by their own mask information generation unit with the received mask information, and using the integrated information, execute mask processing on the sound of time tx.

Since the mask processing on the sound of time tx is performed after the information processing apparatus determines whether the mask information of time tx has been received, a slight delay occurs. Therefore, each information processing apparatus needs to buffer the sounds for a predetermined duration in a predetermined storage region. The predetermined storage region may be provided by the storage medium 104, for example.

Further, in the present exemplary embodiment, although mask processing on sounds at the same time point was performed using mask information from a single time point, mask processing on the sound at a time point to which attention is being paid may also be performed by using mask information from a plurality of time points near to the time point to which attention is being paid, as shown in the following equation (1), for example.

$$H(t)=\alpha M(t)+\beta M(t-1)+\gamma M(t-2) \quad (1)$$

Here, H(t) is the mask information used in the processing for masking the sound at a time point to which attention is being paid, and M(t), M(t−1), and M(t−2) are mask information corresponding to the sounds recorded at times t, t−1, and t−2. Further, $\alpha+\beta+\gamma=1$.

Thus, for example, if the sound at time t is masked using mask information H(t), and the sound at time t+1 is masked using mask information H(t+1), if the presence of masking changes between time points close to each other, distortion in the output sound is suppressed even if the frequency to be masked greatly changes.

Further, in the present exemplary embodiment, as the mask information, although the formant frequency component is removed or attenuated by the mask unit, the present invention is not limited to that. For example, a filter coefficient produced by analyzing the frequency of a speech segment and generating an inverse filter for cancelling out the frequency characteristic of that speech segment may also be used as the mask information. In addition, noise may be superimposed over a speech frequency characteristic. Still further, by simply using only the time information of a speech segment as the mask information, all of the frequency bands containing a voice in that speech segment may be removed, or a separate sound may be superimposed thereover.

Further, in the present exemplary embodiment, although a monitoring camera was described as an example, the present invention may also be applied to a video camera owned by an individual, for example. When applying the present invention to a video camera owned by an individual, for example, to avoid the operator's voice from being recorded on another person's camera, mask processing is performed.

Moreover, the video cameras may transmit and receive mask information to/from each other using a communication unit such as a wireless local area network (LAN) and Bluetooth.

Each video camera detects the operator's voice or a voice being spoken nearby based on speech segment detection. Since the operator's voice or a voice being spoken nearby is louder than other voices, such as that of the target, by adjusting the parameter relating to the volume of the speech segment detection, the operator's voice or a voice being spoken nearby can be detected without detecting other voices. The mask information of those voices is transmitted to the other video camera.

The method for determining a video camera to which the mask information is transmitted may be performed based on the strength of the wireless LAN or Bluetooth field intensity. If the video camera is provided with a global positioning system (GPS), the video camera may be determined based on its positional information.

Thus, by configuring in the above manner, when the operator speaks toward his/her own camera and his/her voice is recorded on the video camera of another person nearby, that speech can be made more difficult to listen to.

In the first exemplary embodiment, each recording apparatus has an information processing apparatus and mask processing was performed on the recorded sounds. However, the present invention is not limited to this. In a second exemplary embodiment according to the present invention, when sound data recorded by a plurality of microphones installed at different positions is stored on an apparatus such as a storage sever, mask processing is performed by using mask information generated from sound data recorded by a different microphone.

Figure 9:
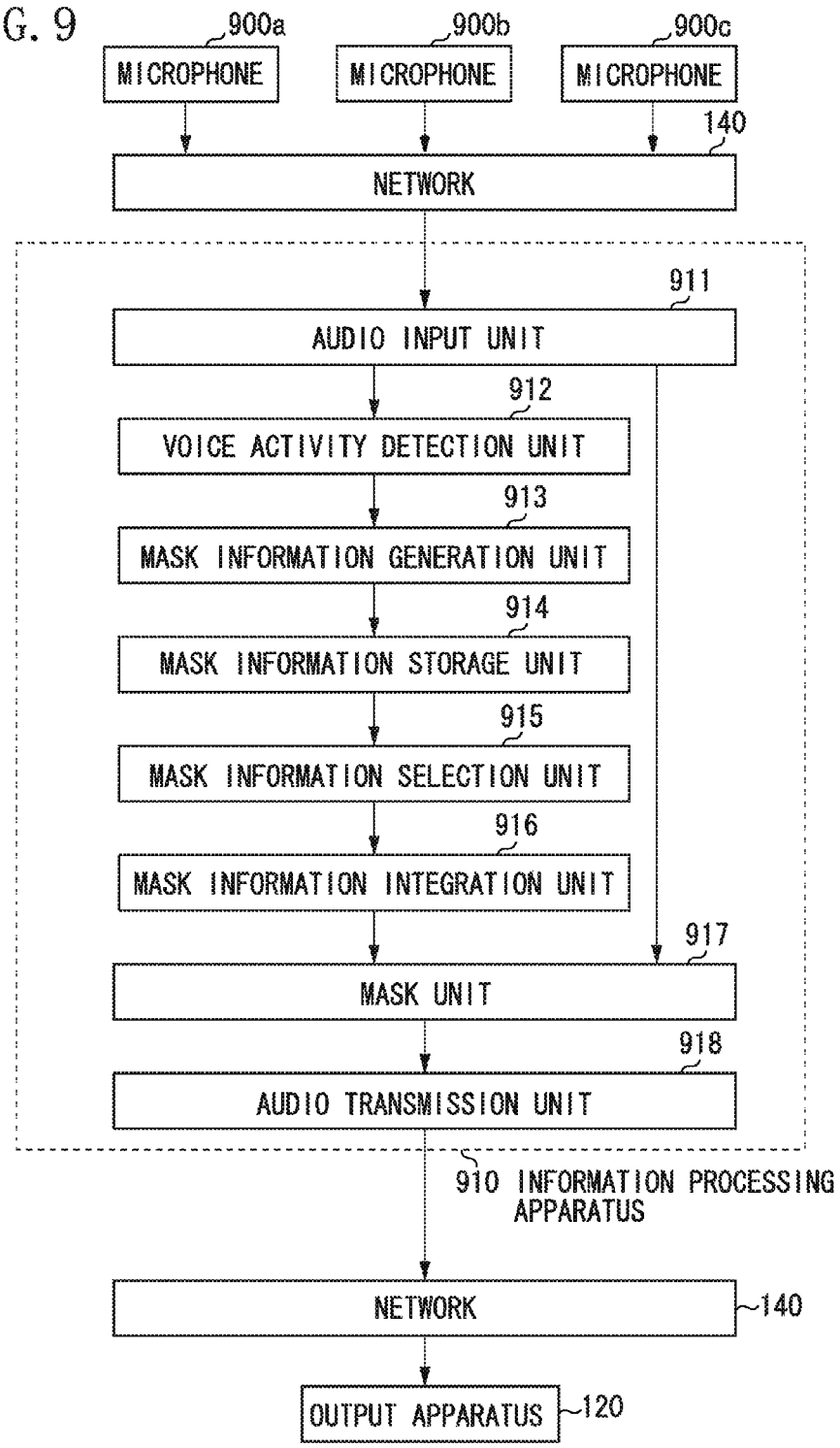
FIG. 9 is a function block diagram illustrating a functional configuration of an information processing apparatus according to a second exemplary embodiment of the present invention.

FIG. 9 is a function block diagram illustrating a functional configuration of an information processing apparatus 910 according to a second exemplary embodiment.

The information processing apparatus 910 has an audio input unit 911, a voice activity detection unit 912, a mask information generation unit 913, a mask information storage unit 914, a mask information selection unit 915, a mask information integration unit 916, a mask unit 917, and an audio transmission unit 918.

The audio input unit 911 temporarily stores sound data recorded by each of a plurality of microphones, and then inputs the sound data into the voice activity detection unit 912 and the mask unit 917. The voice activity detection unit 912 detects speech segments in each of the plurality of pieces of sound data input from the audio input unit 911. If a speech segment is detected by the voice activity detection unit 912, the mask information generation unit 913 generates mask information for that speech segment. The mask information is the same as that described in the first exemplary embodiment, and thus a description thereof is omitted here.

The mask information storage unit 914 temporarily stores the mask information generated by the mask information generation unit 913. The mask information selection unit 915 selects the mask information to be used from among the mask information stored in the mask information storage unit 914.

If the mask information selection unit 915 selects a plurality of pieces of mask information, the mask information integration unit 916 integrates this plurality of pieces of mask information. Since the processing for integrating the mask information is the same as that described in the first exemplary embodiment, a description thereof is omitted here. The mask unit 917 executes mask processing on predetermined sound data by using the mask information integrated by the mask information integration unit or the mask information selected by the mask information selection unit 915. Since the mask processing is the same as that described in the first exemplary embodiment, a description thereof is omitted here.

The audio transmission unit 918 outputs to the output apparatus 120 the sound changed by the mask unit 917 so as to make a portion of the sound more difficult to listen to. If processing to make a portion of the sound more difficult to listen to is unnecessary, the audio transmission unit 918 outputs the sound recorded by a predetermined microphone as is to the output apparatus 120.

Figure 10A:
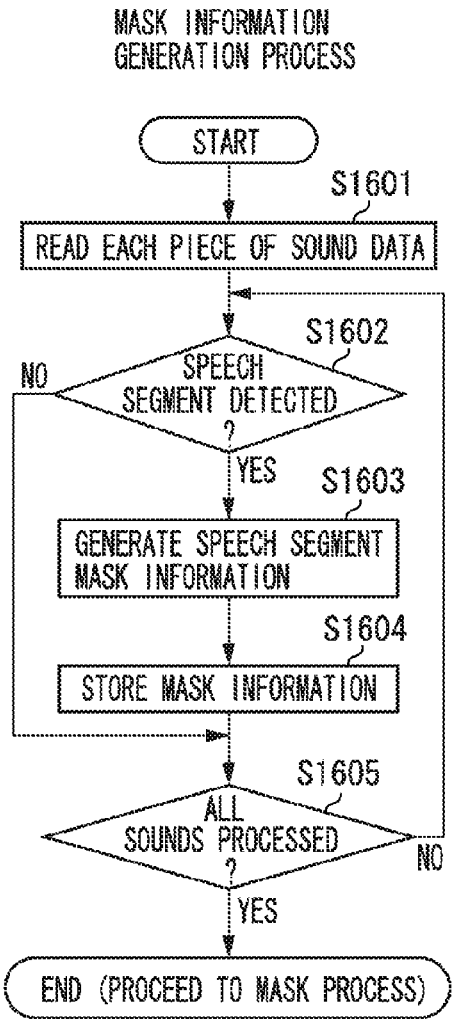
FIGS. 10A and 10B are flowcharts illustrating a process for generating mask information and a process for masking according to the second exemplary embodiment.
Figure 10B:
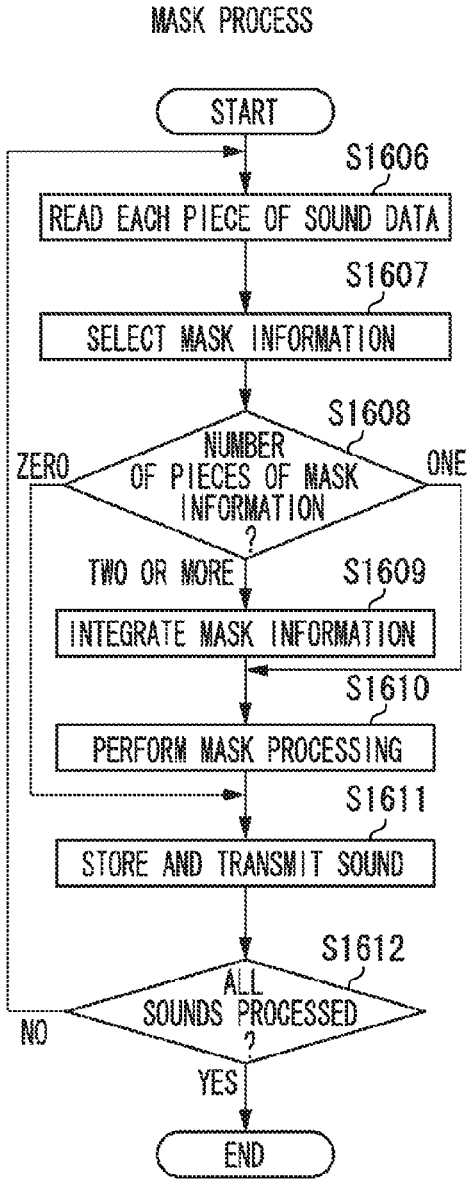

FIGS. 10A and 10B are flowcharts illustrating the processing for making it more difficult to listen to a person's voice included in a recorded sound according to the present exemplary embodiment. FIG. 10A illustrates the processes for generating mask information, and FIG. 10B illustrates the processes for masking.

In the processes for generating mask information of FIG. 10A, first, in step S1601, sound data is read from the audio input unit 911 into the voice activity detection unit 912.

Next, in step S1602, the voice activity detection unit 912 determines whether there is a speech segment in the read sound data. If it is determined that there is a speech segment (YES in step S1602), the processing of step S1603 is then executed.

On the other hand, if it is determined that there is no speech segment in the read sound data (NO in step S1602), the processing of step S1605 is then executed.

In step S1603, the mask information generation unit 913 generates mask information for the detected speech segment.

Next, in step S1604, the mask information storage unit 914 stores the generated mask information in a predetermined storage region.

Next, in step S1605, the voice activity detection unit 912 determines whether all of the sound data read from the audio input unit 911 has been processed. If it is determined that all of the sound data has been processed (YES in step S1605), the series of processes is finished. After the series of processes illustrated in FIG. 10A is finished, the processes for masking illustrated in FIG. 10B are executed.

On the other hand, in step S1605, if it is determined that all of the sound data read from the audio input unit 911 has not been processed (NO in step S1605), the processing from step S1602 is repeated.

In the process of FIG. 10B, first, in step S1606, sound data is read from the audio input unit 911 into the mask unit 917.

Next, in step S1607, the mask information selection unit 915 selects the mask information for masking the sound data read from the audio input unit 911 into the mask unit 917.

The mask information selected by the mask information selection unit 915 is mask information generated from the sound data read from the audio input unit 911 into the mask unit 917, and mask information generated from other sound data.

Further, the selected mask information may be all of the mask information, or may be mask information selected based on the installation position and direction of the microphone that recorded the sound data read from the audio input unit 911 into the mask unit 917, and the volume of the speech segment. In this case, the relationship between the sound data and the installation position and direction of the microphone needs to be stored with the mask information.

Next, in step S1608, the mask information integration unit 916 determines the number of pieces of mask information selected by the mask information selection unit 915. If it is determined that no pieces of mask information is selected, the processing of step S1611 is then executed.

Further, in step S1608, if the mask information integration unit 916 determines that one piece of mask information is selected by the mask information selection unit 915, the processing of step S1610 is then executed.

In addition, in step S1608, if the mask information integration unit 916 determines that two or more pieces of mask information are selected by the mask information selection unit 915, the processing of step S1609 is then executed.

In step S1609, the mask information integration unit 916 executes processing for integrating the plurality of pieces of mask information.

Next, in step S1610, the mask unit 917 executes processing for masking the sound data based on the predetermined mask information.

In step S1611, the audio transmission unit 918 temporarily stores the sound data for which mask processing has been completed, and optionally then transmits the sound data to a predetermined output apparatus.

Next, in step S1612, the mask information selection unit 915 determines whether mask information corresponding to all of the sound data has been selected. If it is determined that there is some sound data that has not yet been selected (NO in step S1612), the processing from step S1606 is repeated.

On the other hand, in step S1612, if the mask information selection unit 915 determines that mask information corresponding to all of the sound data has been selected (YES in step S1612), the series of processes is finished.

Thus, mask processing can be performed based on mask information for a speech segment detected from a plurality of pieces of sound data even when the sounds received from a plurality of microphones are stored in a single apparatus.

In a third exemplary embodiment of the present invention, in addition to the first exemplary embodiment, a determination is made whether to execute mask processing based on a speech segment characteristic. Further, the recording apparatus to which the mask information is transmitted is selected based on the installation position and direction of the recording apparatus, and the volume. In addition, in the third exemplary embodiment, the mask information is corrected based on the distance between recording apparatuses.

Figure 11:
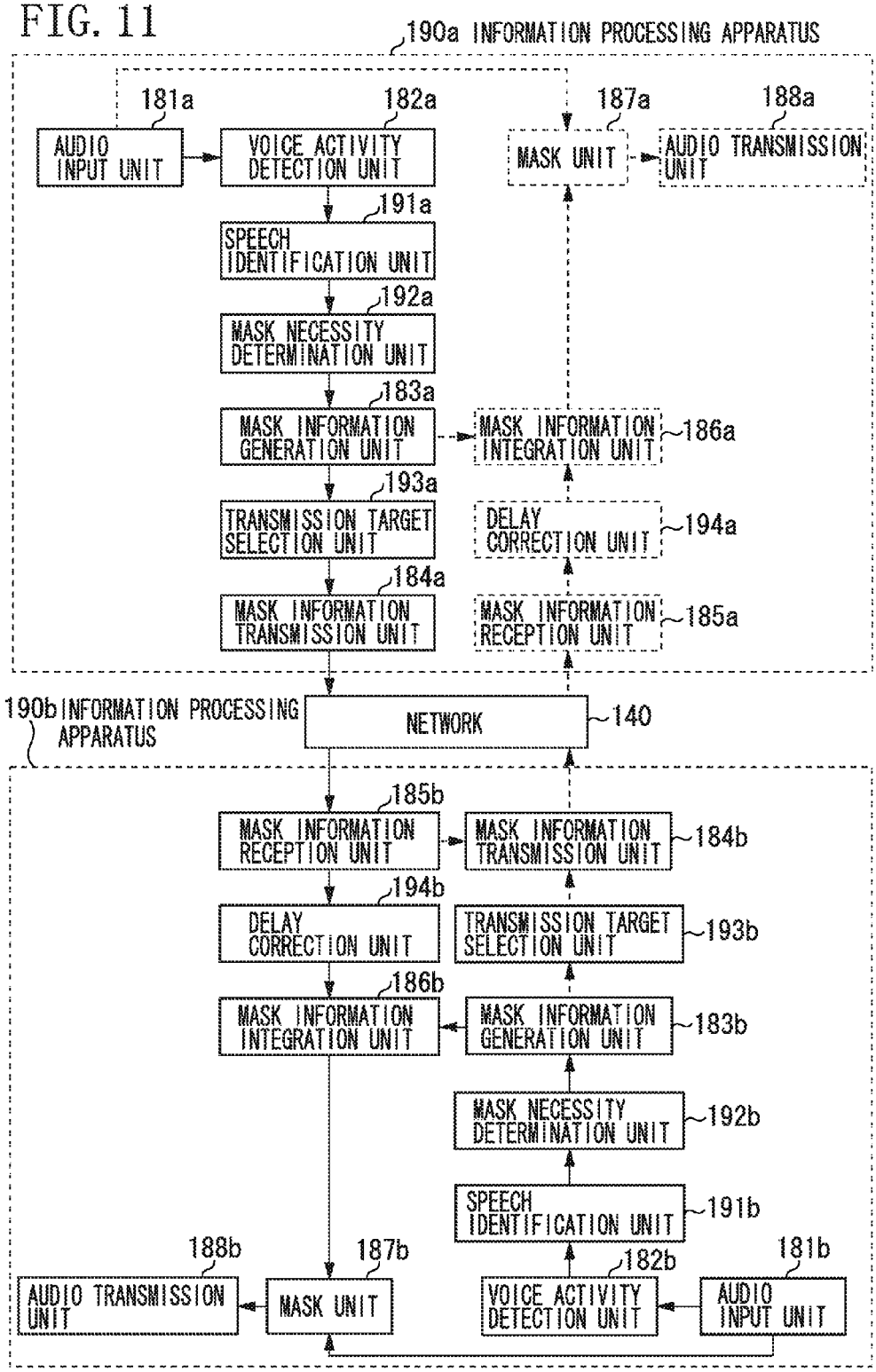
FIG. 11 illustrates an example of a configuration of each of two information processing apparatuses according to a third exemplary embodiment of the present invention.

FIG. 11 is a function block diagram illustrating an information processing apparatus according to the present exemplary embodiment. Similar to FIG. 5, the information processing apparatus corresponding to recording apparatus 100*a* is an information processing apparatus 190*a*, and the information processing apparatus corresponding to recording apparatus 100*b* is an information processing apparatus 190*b*. Further, units having the same function as the units described in the first exemplary embodiment are denoted with the same reference numerals, and thus a description thereof is omitted here.

The information processing apparatuses 190*a* and 190*b* have, respectively, speech identification units 191*a* and 191*b*, mask necessity determination units 192*a* and 192*b*, transmission target selection units 193*a* and 193*b*, and delay correction units 194*a* and 194*b*. These units will now be described.

The speech identification units 191*a* and 191*b* identify the type of speech in a speech segment. The mask necessity determination units 192*a* and 192*b* determine whether to mask a speech segment based on the identification result of the speech identification units 191*a* and 191*b*. The transmission target selection units 193*a* and 193*b* select the recording apparatus to which mask information is transmitted based on the installation position and direction of the recording apparatus and the volume of the speech segment. The delay correction units 194*a* and 194*b* calculate a delay in the sound based on a distance between the recording apparatuses, and correct a time point to be associated with the mask information received by mask information reception units 185*a* and 185*b*.

Figure 12:
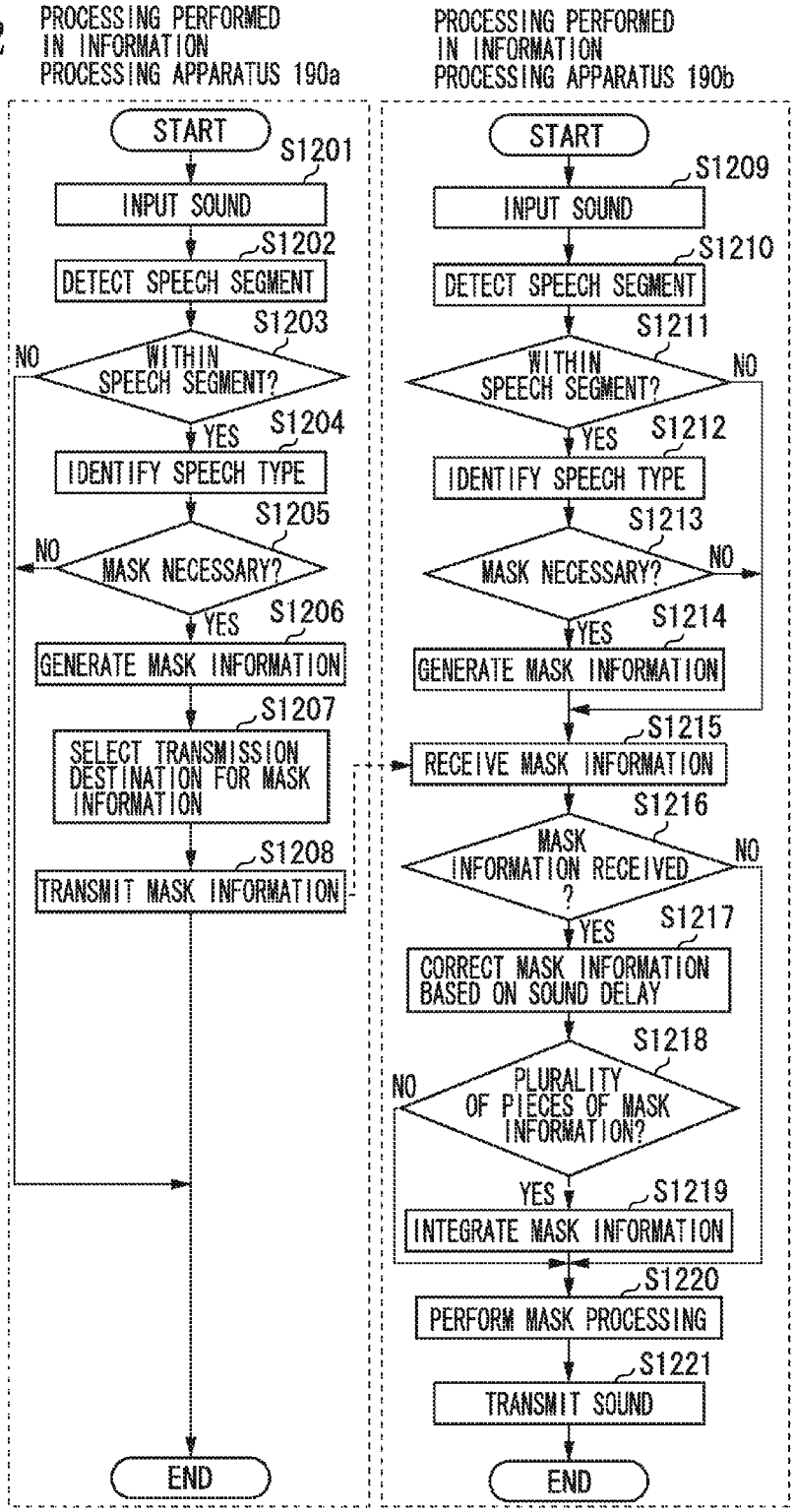
FIG. 12 is a flowchart illustrating processing for making it more difficult to listen to a person's voice included in a recorded sound according to the third exemplary embodiment.

FIG. 12 is a flowchart illustrating processing in which the information processing apparatus 190*a* and information processing apparatus 190*b* cooperate to make it more difficult to listen to a person's voice included in a sound recorded by the recording apparatus 100*b*.

The processing performed in steps S1201 to S1208 is executed by the information processing apparatus 190*a*, and the processing performed in steps S1209 to S1221 is executed by the information processing apparatus 190*b*.

First, in step S1201, the audio input unit 181*a* inputs the sound recorded via the microphone of the recording apparatus 100*a* into the voice activity detection unit 182*a* and the mask unit 187*a*.

Next, in step S1202, the voice activity detection unit 182*a* executes processing for detecting speech segments in the input sound.

Next, in step S1203, the voice activity detection unit 182*a* determines whether each time point serving as a boundary when the input sound is divided into predetermined smaller periods lies within a speech segment. If it is determined that a time point does lie within a speech segment (YES in step S1203), the processing of step S1204 is then executed.

On the other hand, in step S1203, if the voice activity detection unit 182*a* determines that the time point serving as the processing target does not lie within a speech segment (NO in step S1203), the series of processes performed by the information processing apparatus 190*a* is finished.

In step S1204, the speech identification unit 191*a* identifies the type of sounds included in a speech segment. The sound identification will be described below.

Next, in step S1205, the mask necessity determination unit 192*a* determines whether to mask a sound based on the identification result of the speech identification unit 191*a*.

In step S1205, if the mask necessity determination unit 192*a* determines that masking is to be performed (YES in step S1206), the processing of step S1206 is then executed. On the other hand, if it is determined not to perform masking (NO in step S1206), the series of processes performed by the information processing apparatus 190*a* is finished.

In step S1206, the mask information generation unit 183*a* generates mask information for each time point determined, by the mask necessity determination unit 192*a*, that masking is to be performed.

Next, in step S1207, the transmission target selection unit 193*a* selects a destination information processing apparatus (in the present exemplary embodiment, information processing apparatus 190*b*) to which to transmit the mask information based on the relationship between the installation position and installation direction of the recording apparatuses and the volume of the speech segment. The processing performed by the transmission target selection unit 193*a* will be described below.

Next, in step S1208, the mask information output unit 184*a* converts the mask information generated by the mask information generation unit 183*a* into a predetermined signal, and transmits the signal to the information processing apparatus selected by the transmission target selection unit 193*a*.

The processing from steps S1209 to S1214 is the same as the processing from steps S1201 to S1206, and thus a description thereof is omitted here.

Next, in step S1215, the mask information reception unit 185*b* executes processing for receiving a signal that represents the mask information transmitted by the mask information transmission unit 184*a*.

Next, in step S1216, the mask information reception unit 185*b* determines whether a signal representing the mask information has been received. If it is determined that such a signal has been received (YES in step S1216), the processing of step S1217 is then executed.

On the other hand, in step S1216, if the mask information reception unit 185*b* determines that a signal representing the mask information has not been received (NO in step S1216), the processing of step S1220 is then executed.

In step S1217, the delay correction unit 194*b* corrects (delays) the mask information corresponding to the received signal by just the sound delay time.

The "sound delay time" is estimated based on the distance between the recording apparatuses, which is determined based on the speed of sound and the installation positions of the recording apparatuses.

Further, the delay time may also be determined by calculating the distance between the recording apparatus and a sound source position. The sound source position can be estimated based on intersection points of sound source directions estimated by a plurality of recording apparatuses each having a plurality of microphones.

In step S1218, the mask information integration unit 186*b* determines whether there is a plurality of pieces of mask information. If it is determined that there is a plurality of pieces of mask information (YES in step S1218), the processing of step S1219 is then executed.

On the other hand, in step S1218, if it is determined that there is only one piece of mask information (NO in step S1218), the processing of step S1220 is then executed.

The expression "there is a plurality of pieces of mask information" refers to a state in which the mask information reception unit 185*b* receives a signal representing mask information at a predetermined time t, and the delay correction unit 194*b* generates mask information corrected at the same time t.

In step S1219, the mask information integration unit 186*b* executes processing for integrating the mask information. The processing for integrating the mask information will be described below.

Next, in step S1220, the mask unit 187*b* executes processing for masking the sound input by the audio input unit 181*b* based on one piece of mask information or the mask information integrated by the mask information integration unit 186*b*.

This "mask processing" is the processing illustrated in FIGS. 3A to 3I and FIGS. 4A to 4I, and refers to processing for making it more difficult to listen to a person's voice included in a sound. If there is no mask information, the mask processing illustrated in step S1220 is not executed.

Next, in step S1221, the audio transmission unit 188*b* transmits a signal representing a sound which has undergone appropriate mask processing to the output apparatus 120.

The above is the processing for making it more difficult to listen to a person's voice included in a sound recorded by the recording apparatus 100*b*.

Next, the processing for identifying speech will be described. The processing for identifying speech is, for example, processing for identifying a laughing voice, a crying voice, and a yelling voice.

Therefore, the speech identification unit 191*a* has a laughing voice identification unit, a crying voice identification unit, and a yelling voice identification unit, for identifying whether a laughing voice, a crying voice, and a yelling voice are included in a speech segment.

Generally, a laughing voice, a crying voice, and a yelling voice do not contain personal information or confidential information. Therefore, if a laughing voice, a crying voice, or a yelling voice is identified in a speech segment, the mask necessity determination unit 192*a* does not mask that speech segment.

Further, in speech segment detection, if the detection accuracy is not high, a segment in which a loud sound other than voices (non-vocal sounds such as the sound of the wind, sound from an automobile, and an alarm sound) is output may be detected as a speech segment. Therefore, if the speech identification unit 191*a* identifies a non-vocal sound, such as the sound of the wind, sound from an automobile, and an alarm sound, in the speech segment as a result of identification of the sound of the wind, sound from an automobile, or an alarm sound, the mask necessity determination unit 192*a* does not mask that speech segment.

In addition, usually, in everyday conversation, meaningless speech (e.g., "ahh . . . ", "em . . . " etc.) may be uttered. If meaningless speech is recognized as speech using a dictionary for large vocabulary voice recognition, the recognition often ends in failure. Therefore, if recognition fails due to the speech identification unit 191*a*, which has a dictionary for large vocabulary voice recognition, performing voice recognition using the dictionary for large vocabulary voice recognition, the mask necessity determination unit 192*a* does not mask that speech segment.

Further, if the recording apparatus is installed in a shopping mall, for example, when the volume of a speech segment is louder than a predetermined value, this voice may be a public address announcement. Therefore, the speech identification unit 191*a* has a volume detection unit for measuring the volume of a speech segment. If the speech identification unit 191*a* measures the volume of a speech segment to be greater than a predetermined threshold, the mask necessity determination unit 192*a* does not mask that speech segment. Further, regarding the determination of masking necessity based on volume, the volume level serving as the threshold may be adjusted based on an attribute (level of public openness etc.) of the location where the recording apparatus is installed.

Moreover, no matter which of the above-described methods is employed by the speech identification unit 191*a* for sound identification, sometimes identification cannot be performed unless the sound data is of a certain length. Alternatively, the processing may require some time to perform.

In such a case, a delay occurs between speech segment detection and mask information generation. Therefore, it is necessary to either buffer a sufficient amount of sound data until the mask processing is performed, or to set the predetermined frame T, which is a processing unit, to be larger.

Figure 13:
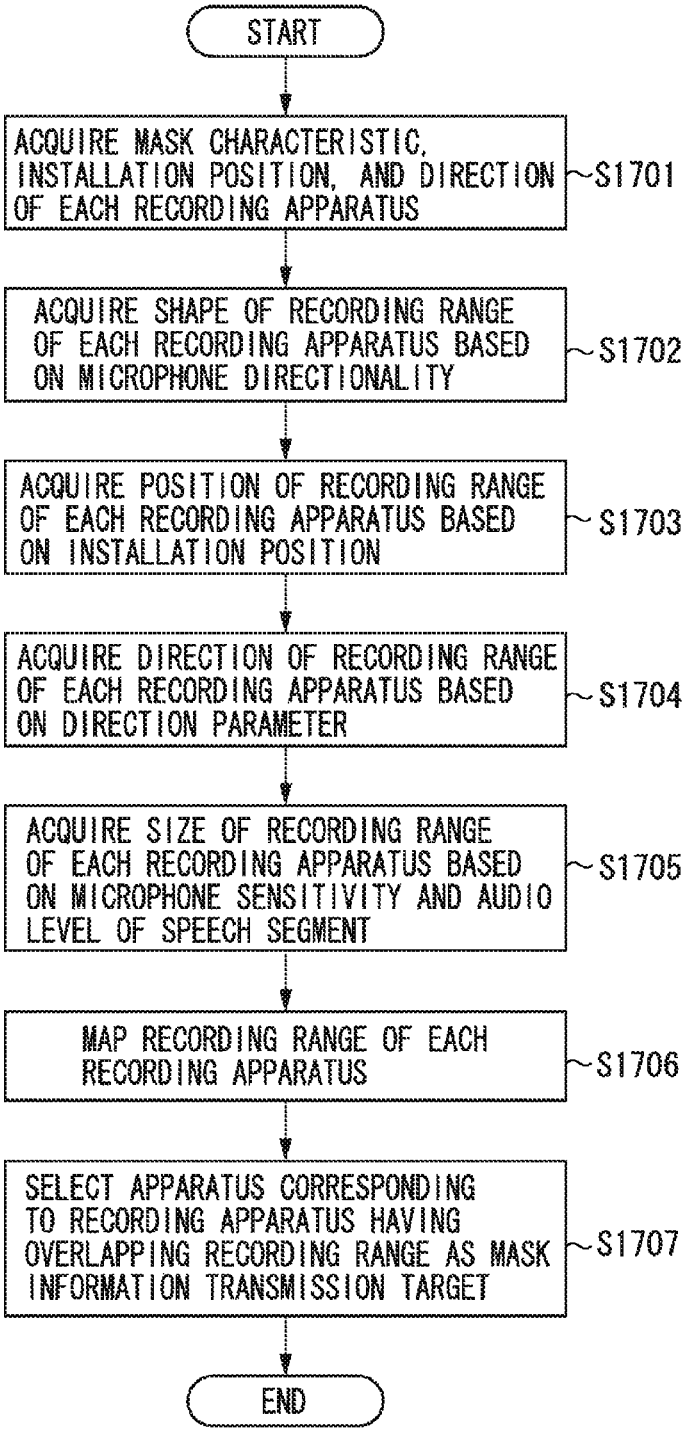
FIG. 13 is a flowchart illustrating an example of a process for selecting a transmission target according to the third exemplary embodiment.

FIG. 13 is a flowchart illustrating an example of a processing flow in which the transmission target selection unit 193*a* selects a transmission target.

First, in step S1701, the transmission target selection unit 193*a* acquires a microphone characteristic (directionality and sensitivity), installation position, and direction of each recording apparatus. These parameters may be stored as preset fixed values, or may be acquired each time a value changes, like the direction parameter of the monitoring camera. Parameters changed from other recording apparatuses are to be acquired via the network 140.

Next, in step S1702, the transmission target selection unit 193*a* acquires the shape of the recording range based on the directionality parameter of a microphone of each recording apparatus.

Next, in step S1703, the transmission target selection unit 193*a* acquires the position of the recording range based on the installation position of each recording apparatus.

Next, in step S1704, the transmission target selection unit 193*a* acquires the direction of the recording range based on the direction of each recording apparatus.

Next, in step S1705, the transmission target selection unit 193*a* determines the size of the recording range based on a sensitivity setting of a microphone of each recording apparatus.

At this stage, the size of the recording range may be adjusted along with the volume of the speech segment for which the mask information to be transmitted was generated. For example, for a loud volume, the recording range of each recording apparatus is widened in order to enable recording even from a distant recording apparatus.

Next, in step S1706, the transmission target selection unit 193*a* performs mapping based on the shape, position, direction, and size of the respective recording ranges.

Next, in step S1707, the transmission target selection unit 193*a* selects only the information processing apparatus corresponding to the recording apparatus overlapping the mapped recording range as the mask information transmission target.

In the present exemplary embodiment, although the mask information transmission target is determined based on microphone directionality and sensitivity, speech segment volume, and the position and direction of the recording apparatuses, the determination can also be made by using only some of these.

Further, even if the recording range is not defined, the transmission target can be determined based on the relationship between the position and direction between the transmission source and destination recording apparatuses. For example, a recording apparatus within a predetermined direction may be set as the mask information transmission target using only the installation positions of the recording apparatuses. In addition, the mask information transmission target can be selected based on whether the respective installation positions of the recording apparatuses are in the same room.

Figure 14:
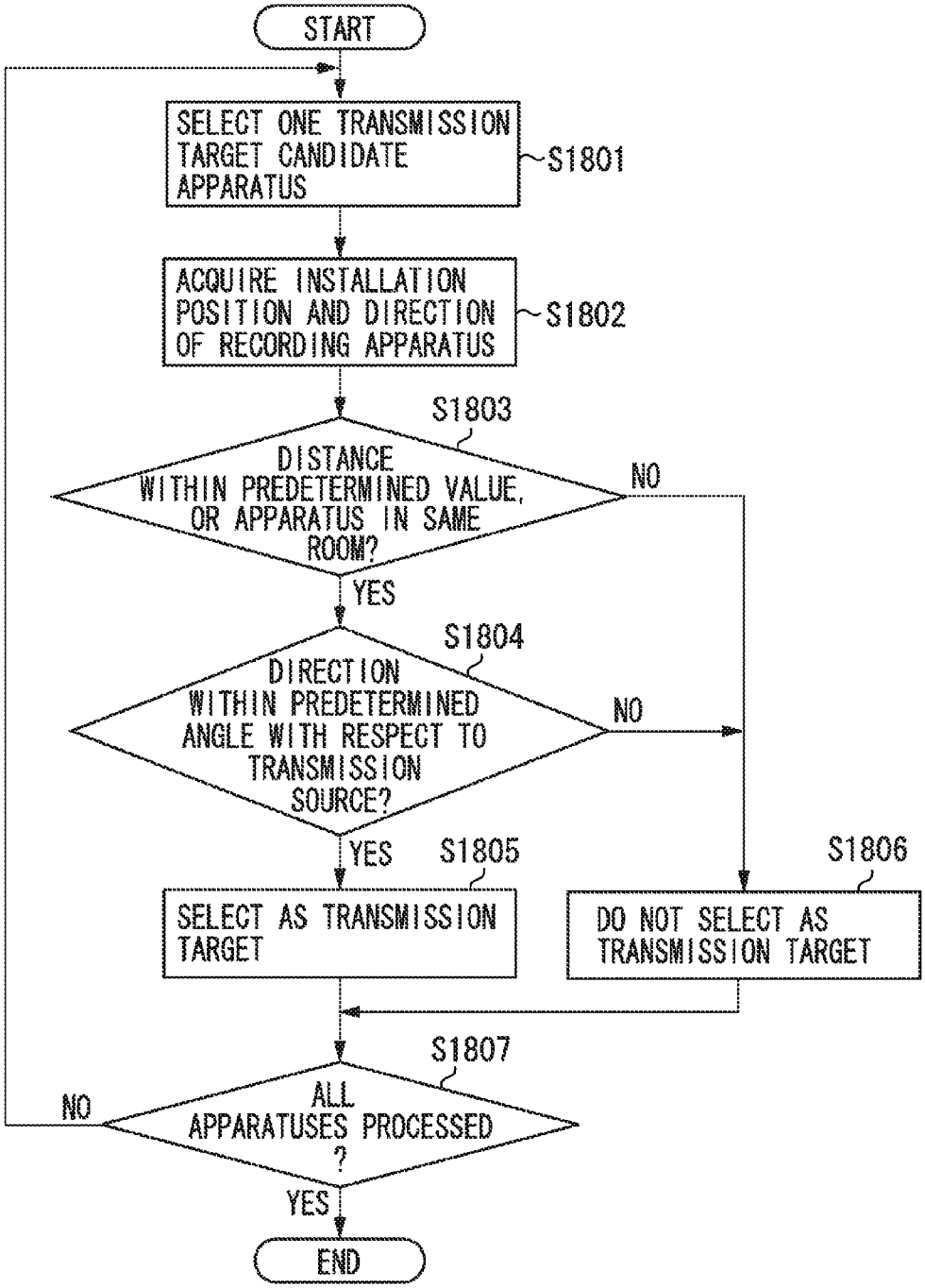
FIG. 14 is a flowchart illustrating another example of a process for selecting a transmission target according to the third exemplary embodiment.

FIG. 14 is a flowchart illustrating another example of a processing flow in which the transmission target selection unit 193*a* selects the transmission target.

First, in step S1801, the transmission target selection unit 193*a* selects a recording apparatus corresponding to an information processing apparatus that will serve as a transmission target candidate.

Next, in step S1802, the transmission target selection unit 193*a* acquires the installation position and the direction of the selected recording apparatus.

Next, in step S1803, the transmission target selection unit 193*a* checks whether the direction between the recording apparatus corresponding to the information processing apparatus that will serve as a transmission source for transmitting the mask information and the recording apparatus corresponding to the information processing apparatus that will serve as a transmission target candidate is within a predetermined value.

The processing performed in step S1803 may also be performed as processing performed by the transmission target selection unit 193*a* checking whether the selected recording apparatus is in the same room as the recording apparatus corresponding to the information processing apparatus that will serve as a transmission source.

In step S1803, if the transmission target selection unit 193*a* determines that the distance between the recording apparatuses is within the predetermined value (YES in step S1803), or determines that the recording apparatuses are in the same room (YES in step S1803), the processing of step S1804 is then executed.

On the other hand, in step S1803, if the transmission target selection unit 193*a* determines that the distance between the recording apparatuses is not within the predetermined value (NO in step S1803), or determines that the recording apparatuses are not in the same room (NO in step S1803), the processing of step S1806 is then executed.

In step S1804, the transmission target selection unit 193*a* determines whether the direction of the recording apparatus corresponding to the information processing apparatus that will serve as a transmission target candidate is within a predetermined angle with respect to the recording apparatus corresponding to the information processing apparatus serving as the transmission source.

In step S1804, if the transmission target selection unit 193*a* determines that the direction is within the predetermined angle (YES in step S1804), the processing of step S1805 is then executed. On the other hand, if the transmission target selection unit 193*a* determines that the direction is not within the predetermined angle (NO in step S1804), the processing of step S1806 is then executed.

In step S1805, the transmission target selection unit 193*a* selects the information processing apparatus serving as the transmission target candidate as a transmission target.

In step S1806, the transmission target selection unit 193*a* does not select the information processing apparatus serving as the transmission target candidate as a transmission target.

In step S1807, the transmission target selection unit 193*a* determines whether a determination regarding whether all of the information processing apparatuses serving as a transmission target candidate are the transmission targets has been made.

In step S1807, if the transmission target selection unit 193*a* determines that a determination regarding whether all of the information processing apparatuses serving as a transmission target candidate are the transmission targets has been made (YES in step S1807), the series of processes is finished.

On the other hand, in step S1807, if the transmission target selection unit 193*a* determines that a determination regarding whether all of the information processing apparatuses serving as a transmission target candidate are the transmission targets has not been made (NO in step S1807), the series of processes from S1801 is repeated.

Thus, as illustrated in FIGS. 13 and 14, the transmission target selection unit 193*a* can select the information processing apparatus that will serve as a transmission target based on various methods.

In the present exemplary embodiment, although the transmission target selection unit 193*a* is described as selecting the information processing apparatus to which the mask information is transmitted, the present invention is not limited to this. This may be performed by selecting whether an information processing apparatus that receives mask information can use the mask information. In this case, the transmission side transmits the mask information to all of the information processing apparatuses. On the other hand, the reception-side information processing apparatuses, which have a mask information selection unit respectively, select only the mask information received from an information processing apparatus that corresponds to the recording apparatus having an overlapping recording range based on a predetermined recording range.

Thus, as described above, according to the present exemplary embodiment, in addition to the first exemplary embodiment, a determination is made whether to execute mask processing based on a speech segment characteristic. Further, the information processing apparatus to which the mask information is transmitted is selected based on the installation position and direction of the recording apparatus, a microphone characteristic, and the volume of the speech segment. In addition, in the third exemplary embodiment, the mask information is corrected based on the distance between the recording apparatuses. Consequently, masking can be accurately performed on only the sounds that need to be masked.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-040598 filed Feb. 25, 2010, which is hereby incorporated by reference herein in its entirety.

What is claimed is:

1. A system comprising:

a first information processing apparatus; and a second information processing apparatus, wherein the first information processing apparatus comprises:

a first acquisition unit configured to acquire a first sound;

a detection unit configured to detect a speech segment, from the first sound;

a determination unit configured to determine, by performing a frequency analysis of the speech segment, a first frequency band which is a frequency band representing a voice and a second frequency band which is a frequency band other than the frequency band representing a voice; and a transmission unit configured to transmit information regarding the first frequency band and the second frequency band, wherein the second information processing apparatus comprises:

a second acquisition unit configured to acquire a second sound; and a change unit configured to, from among frequency components representing the second sound, change a frequency component in the first frequency band, wherein the change unit does not change a frequency component in the second frequency band.

2. An information processing apparatus, comprising:

a first acquisition unit configured to acquire, from a device different from the information processing apparatus, information regarding a first frequency band and a second frequency band, wherein the first frequency band is obtained by performing a frequency analysis of a first sound acquired in the device different from the information processing apparatus and the first frequency band represents a voice, and wherein the second frequency band is a frequency band other than the frequency band representing a voice, a second acquisition unit configured to acquire a second sound; and a change unit configured to specify the first frequency band from among frequency components representing the second sound based on the acquired information, and change a frequency component in the first frequency band, wherein the change unit does not change a frequency component in the second frequency band.

3. The information processing apparatus according to claim 2, wherein the change unit is configured to attenuate a frequency component in the first frequency band from among frequency components representing the second sound.

4. The information processing apparatus according to claim 2, wherein the first frequency band is a frequency band based on a formant in a spectral envelope obtained by analyzing the frequency of the first sound.

5. The information processing apparatus according to claim 2, wherein the first frequency band is a frequency band including a peak of a formant in a spectral envelope obtained by analyzing the frequency of the first sound.

6. The information processing apparatus according to claim 2, wherein the second sound is a sound recorded at a time corresponding to when the first sound was recorded.

7. A method for controlling an information processing apparatus, comprising:

acquiring, from a device different from the information processing apparatus, information regarding a first frequency band and a second frequency band, wherein the first frequency band is obtained by performing a frequency analysis of a first sound acquired in the device different from the information processing apparatus and the first frequency band represents a voice, and wherein the second frequency band is a frequency band other than the frequency band representing a voice, acquiring a second sound;

specifying the first frequency band from among frequency components representing the second sound based on the acquired information; and changing a frequency component in the first frequency band, wherein a frequency component in the second frequency band is not changed.

8. A non-transitory computer-readable storage medium storing a computer program that is read into a computer to cause the computer to execute the method according to claim 7.

* * * * *